US009237768B2

(12) United States Patent
Carroll et al.

(10) Patent No.: US 9,237,768 B2
(45) Date of Patent: Jan. 19, 2016

(54) PREFORMED SMOKELESS TOBACCO PRODUCT

(71) Applicant: ALTRIA CLIENT SERVICES LLC, Richmond, VA (US)

(72) Inventors: Andrew Nathan Carroll, Chester, VA (US); Shannon Maxwell Black, Richmond, VA (US); Tommy C. Holland, Midlothian, VA (US); Jason Andrew Macko, Richmond, VA (US); Christopher Joseph DiNovi, Ruther Glen, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days.

(21) Appl. No.: 14/162,209

(22) Filed: Jan. 23, 2014

(65) Prior Publication Data

US 2014/0130818 A1 May 15, 2014

Related U.S. Application Data

(63) Continuation of application No. 13/086,082, filed on Apr. 13, 2011.

(60) Provisional application No. 61/324,190, filed on Apr. 14, 2010, provisional application No. 61/421,931, filed on Dec. 10, 2010.

(51) Int. Cl.

| | |
|---|---|
| ***A24B 15/00*** | (2006.01) |
| ***A24B 13/00*** | (2006.01) |
| ***A24B 15/18*** | (2006.01) |

(52) U.S. Cl.

CPC ..... *A24B 13/00* (2013.01); *A24B 15/18* (2013.01)

(58) Field of Classification Search

CPC ..... A24B 13/00; A24F 23/00
USPC ..... 131/352, 275
See application file for complete search history.

(56) References Cited

U.S. PATENT DOCUMENTS

| | | | |
|---|---|---|---|
| 114,901 | A | 5/1871 | Alden |
| 203,363 | A | 5/1878 | Muth |

(Continued)

FOREIGN PATENT DOCUMENTS

| | | |
|---|---|---|
| JP | 2009-508523 | 3/2009 |
| JP | 2009-517647 | 4/2009 |

(Continued)

OTHER PUBLICATIONS

International Search Report and Written Opinion for Application No. PCT/US2011/032329, dated Aug. 17, 2011, 12 pages.

(Continued)

*Primary Examiner* — Richard Crispino
*Assistant Examiner* — Dionne W Mayes
(74) *Attorney, Agent, or Firm* — Fish & Richardson P.C.

(57) ABSTRACT

Some embodiments of a smokeless tobacco system include one or more preformed smokeless tobacco products configured to generally retain their shape during processing, shipping, and consumer handling. In particular embodiments, each smokeless tobacco product can comprise a moist smokeless tobacco in combination with a selected binder such that the final product is configured to have material properties providing improved handling, an improved mouth feel, and a satisfying flavor profile.

21 Claims, 12 Drawing Sheets

(56) References Cited

U.S. PATENT DOCUMENTS

| | | | |
|---|---|---|---|
| 639,366 | A | 12/1899 | Dudley |
| 865,026 | A | 9/1907 | Ellis |
| 904,521 | A | 11/1908 | Ellis |
| D56,903 | S | 1/1921 | Wentz |
| D56,913 | S | 1/1921 | Edgerton |
| 1,376,586 | A | 5/1921 | Schwartz |
| D101,888 | S | 11/1936 | Ringold |
| D133,008 | S | 7/1942 | McCall |
| 2,826,906 | A | 3/1953 | Rice |
| 2,635,273 | A | 4/1953 | Logan |
| 2,708,175 | A | 5/1954 | Samfield et al. |
| 2,887,414 | A | 5/1959 | Rosenberg et al. |
| 3,016,907 | A | 1/1962 | Rosenberg et al. |
| 3,693,629 | A | 9/1972 | Broughton |
| 4,081,394 | A | 3/1978 | Bartley |
| 4,098,421 | A | 7/1978 | Foster |
| 4,144,894 | A | 3/1979 | Schmidt et al. |
| D258,091 | S | 1/1981 | Reed et al. |
| 4,317,837 | A | 3/1982 | Kehoe et al. |
| 4,459,987 | A | 7/1984 | Pangburn |
| 4,513,756 | A | 4/1985 | Pittman et al. |
| 4,545,392 | A | 10/1985 | Sensabaugh, Jr. et al. |
| 4,572,222 | A | 2/1986 | Pangburn |
| 4,596,259 | A | 6/1986 | White et al. |
| 4,624,269 | A | 11/1986 | Story et al. |
| 4,712,552 | A | 12/1987 | Pangburn |
| 4,917,161 | A | 4/1990 | Townend |
| 4,972,855 | A | 11/1990 | Kuriyama et al. |
| 5,387,416 | A | 2/1995 | White et al. |
| D377,085 | S | 12/1996 | Tortarolo |
| 5,584,306 | A | 12/1996 | Beauman et al. |
| 5,651,642 | A | 7/1997 | Kelley, Jr. et al. |
| 5,679,467 | A | 10/1997 | Priluck |
| 5,873,206 | A | 2/1999 | Roberts |
| 5,955,417 | A | 9/1999 | Taylor |
| D419,261 | S | 1/2000 | Binstock et al. |
| D420,171 | S | 2/2000 | Fauerbach et al. |
| D430,285 | S | 8/2000 | Chen et al. |
| D430,662 | S | 9/2000 | Kobayashi |
| D467,385 | S | 12/2002 | Crawford |
| D490,565 | S | 5/2004 | Ali |
| 6,817,154 | B2 | 11/2004 | Dolan et al. |
| 6,834,654 | B2 | 12/2004 | Williams |
| 6,877,290 | B2 | 4/2005 | Mason |
| 7,073,476 | B2 | 7/2006 | Yamamura et al. |
| D534,646 | S | 1/2007 | Chang et al. |
| D535,017 | S | 1/2007 | Stawski et al. |
| D537,363 | S | 2/2007 | Petrucci |
| D538,472 | S | 3/2007 | Angeletta |
| D538,973 | S | 3/2007 | Angeletta |
| D564,086 | S | 3/2008 | Nielsen et al. |
| D574,516 | S | 8/2008 | Bouchard |
| D610,674 | S | 2/2010 | Karolak et al. |
| 7,661,433 | B2 | 2/2010 | Calandro et al. |
| D624,437 | S | 9/2010 | Leclezio |
| 7,810,507 | B2 | 10/2010 | Dube et al. |
| D630,525 | S | 1/2011 | Patel et al. |
| 7,983,465 | B2 | 7/2011 | Leroux et al. |
| D646,734 | S | 10/2011 | Findeisen |
| 8,033,425 | B2 | 10/2011 | Gelardi |
| D674,134 | S | 1/2013 | Carroll et al. |
| D674,536 | S | 1/2013 | Macko et al. |
| D674,537 | S | 1/2013 | Macko et al. |
| D674,538 | S | 1/2013 | Macko et al. |
| 8,370,112 | B2 | 2/2013 | Wrede et al. |
| 2004/0062838 | A1 | 4/2004 | Catellanos et al. |
| 2004/0074192 | A1 | 4/2004 | Mason |
| 2004/0118422 | A1 | 6/2004 | Lundin et al. |
| 2004/0123873 | A1 | 7/2004 | Calandro et al. |
| 2004/0217024 | A1 | 11/2004 | Arnarp et al. |
| 2005/0091940 | A1 | 5/2005 | Whitson |
| 2005/0244521 | A1 | 11/2005 | Strickland et al. |
| 2006/0191548 | A1* | 8/2006 | Strickland et al. ..... 131/347 |
| 2007/0062549 | A1 | 3/2007 | Holton et al. |
| 2007/0186941 | A1 | 8/2007 | Holton et al. |
| 2008/0029110 | A1 | 2/2008 | Dube et al. |
| 2008/0149121 | A1 | 6/2008 | Wrenn et al. |
| 2008/0187143 | A1 | 8/2008 | Mak-Fan |
| 2008/0206432 | A1 | 8/2008 | Torrens et al. |
| 2008/0298902 | A1 | 12/2008 | Knudson et al. |
| 2009/0025738 | A1 | 1/2009 | Mua et al. |
| 2009/0025739 | A1 | 1/2009 | Brinkley et al. |
| 2009/0065013 | A1 | 3/2009 | Essen et al. |
| 2009/0133703 | A1 | 5/2009 | Strickland et al. |
| 2009/0133704 | A1 | 5/2009 | Strickland et al. |
| 2009/0293889 | A1 | 12/2009 | Kumar et al. |
| 2009/0301028 | A1 | 12/2009 | Pfoff |
| 2009/0306938 | A1 | 12/2009 | Wrede et al. |
| 2010/0000888 | A1 | 1/2010 | Cronin et al. |
| 2010/0101170 | A1 | 4/2010 | Mancine |
| 2010/0187143 | A1 | 7/2010 | Essen |
| 2010/0263310 | A1 | 10/2010 | Wauhop |
| 2010/0294291 | A1 | 11/2010 | Robinson et al. |
| 2011/0023403 | A1 | 2/2011 | Joslyn et al. |
| 2011/0247640 | A1 | 10/2011 | Beeson et al. |
| 2011/0265414 | A1 | 11/2011 | Ciccarelli |
| 2012/0024301 | A1 | 2/2012 | Carroll |
| 2012/0031416 | A1 | 2/2012 | Atchley et al. |
| 2012/0125354 | A1 | 5/2012 | Byrd et al. |
| 2012/0167902 | A1 | 7/2012 | Macko et al. |

FOREIGN PATENT DOCUMENTS

| | | |
|---|---|---|
| JP | 2010-534475 | 11/2010 |
| WO | WO 2006/127772 | 11/2006 |
| WO | WO 2007/037962 | 4/2007 |
| WO | WO 2009/015142 | 1/2009 |
| WO | WO 2009/068279 | 6/2009 |
| WO | WO 2010/060845 | 6/2010 |
| WO | WO 2010/086010 | 8/2010 |
| WO | WO 2011/130414 | 10/2011 |

OTHER PUBLICATIONS

International Search Report and Written Opinion for Application No. PCT/US2011/064109, dated Mar. 2, 2012, 10 pages.

International Preliminary Report on Patentability for PCT/US2011/032329, mailed Oct. 26, 2012, 7 pages.

Koch, Wendy, Tobacco 'Orbs' Melt in Mouth, Dec. 26, 2008, USA Today, www.usatoday.com, pp. 1-2.

Petersik, Sherry, Our Cheap-o Patio Makeover, May 26, 2009, www.younghouselove.com, p. 5.

* cited by examiner

PREFORMED SMOKELESS TOBACCO PRODUCT

CROSS-REFERENCE TO RELATED APPLICATIONS

This application is a continuation of and claims benefit to U.S. application Ser. No. 13/086,082, filed on Apr. 13, 2011, which claims priority to U.S. Application Ser. No. 61/324,190, filed on Apr. 14, 2010 and to U.S. Application Ser. No. 61/421,931, filed on Dec. 10, 2010.

TECHNICAL FIELD

This disclosure relates to a preformed smokeless tobacco product that allows for improved packaging, handling, and consumer satisfaction.

BACKGROUND

Smokeless tobacco is tobacco that is placed the mouth and not combusted. There generally are considered to be three types of smokeless tobacco: chewing tobacco, moist smokeless tobacco, and dry snuff. Chewing tobacco is coarsely divided tobacco leaf that is typically packaged in a large pouch and used in a plug or twist. Moist smokeless tobacco is a moist, more finely divided tobacco that is provided in loose form or in a pouch form and is typically packaged in round cans and used as a pinch or in a pouch placed between the cheek and gum. Dry snuff is finely ground tobacco that is placed in the mouth or used nasally.

SUMMARY

Some embodiments of a smokeless tobacco system include one or more preformed smokeless tobacco products configured to generally retain their shape during processing, shipping, and consumer handling. In particular embodiments, each smokeless tobacco product can include a moist smokeless tobacco in combination with a selected binder such that the preformed tobacco portion has improved handling, improved mouth feel, and satisfying flavor profile. Furthermore, some systems described can include a plurality of the smokeless tobacco products packaged into a container where each of the smokeless tobacco products has a substantially similar shape and provides a substantially similar, predetermined portion of tobacco to an adult tobacco consumer. Such a system can permit an adult tobacco consumer to receive consistent portions of tobacco (e.g., with each deposit of a product portion in the mouth) while also experiencing the tactile and flavor benefits of having the smokeless tobacco externally exposed on the article (e.g., not impeded by a paper-like pouch or sachet). Accordingly, some embodiments of the preformed smokeless tobacco product enable an adult tobacco consumer to handle each individual preformed piece from the container without the tobacco portion falling apart prior to placement in the adult tobacco consumer's mouth.

In some embodiments, the preformed smokeless tobacco product includes a shaped smokeless tobacco body having a defined shape. The shaped smokeless tobacco body includes tobacco and a binder. The preformed smokeless tobacco product has an individual product friability of between 0.5 weight percent and 80 weight percent. In some embodiments, the preformed smokeless tobacco product can have tobacco exposed along one or more exterior surfaces of the preformed smokeless tobacco product.

In some embodiments, a system includes a container including a lid and a base that defines an interior space. A plurality of preformed smokeless tobacco products having a substantially similar shape can be disposed in the interior space of the container. Each of the preformed smokeless tobacco products includes tobacco and a binder compressed into the substantially similar shape such that at least a portion of the tobacco is exposed along exterior surfaces of each of the preformed smokeless tobacco products. The preformed smokeless tobacco products have an average individual product friability of between 0.5 weight percent and 80 weight percent. In some embodiments, each preformed smokeless tobacco product has an individual product friability of between 0.5 weight percent and 80 weight percent. In some embodiments, the system has a whole package friability of less than 20 weight percent, less than 10 weight percent, less than five weight percent, or less than one weight percent.

In some embodiments, a method of consuming tobacco entails opening a container housing a plurality of preformed smokeless tobacco products and placing at least one of the preformed smokeless tobacco products in the mouth of an adult tobacco consumer such that at least a portion of the tobacco contacts tissue in the adult tobacco consumer's mouth. Each preformed smokeless tobacco product in the container has a substantially similar shape. Each preformed smokeless tobacco product includes tobacco and a binder compressed into the substantially similar shape so that the preformed smokeless tobacco products have an average individual product friability of between 0.5 weight percent and 80 weight percent. In some embodiments, at least one preformed smokeless tobacco product is gripped between the thumb and one or more fingers. In certain embodiments, at least one preformed smokeless tobacco product is placed in the mouth of the adult tobacco consumer between a gingival and a lip. The method can, in certain embodiments, include pressing at least one preformed smokeless tobacco product between the gingiva and the lip to accommodate the smokeless tobacco product within the contours of at least a portion of the gingival, the lip, or a combination thereof.

In some embodiments, a method of making a preformed tobacco product entails blending tobacco and a binder into a mixture and compressing at least a portion of the mixture into a shaped smokeless tobacco body having an individual product friability of between 0.5 weight percent and 80 weight percent. The shaped smokeless tobacco body has at least a portion of the tobacco exposed along an exterior surface of the shaped smokeless tobacco body. In some embodiments, the mixture is compressed into a plurality of shaped smokeless tobacco bodies each having a substantially similar shape, each having an individual product friability of between 0.5 weight percent and 80 weight percent, and each having at least a portion of the tobacco exposed along an exterior surface. A plurality of shaped smokeless tobacco bodies can be inserted into a container. The container can be closed and sealed. In some embodiments, the blending can include adding other materials (such as flavorants) into the mixture.

The individual product friability of one or more preformed smokeless tobacco products, in some embodiments, is less than 40 weight percent. The average individual product friability of a plurality of preformed smokeless tobacco products within a container can be less than 40 weight percent. In still other embodiments, the individual product friability of a single preformed smokeless tobacco product or the average individual product friability of a plurality of preformed smokeless tobacco products is less than 10 weight percent. The individual product friability and/or average individual product friability, in some embodiments, is greater than 1.0 weight percent. In some embodiments, the individual product friability and/or average individual product friability is between 1.0 and 4.0 weight percent. For example, one or more preformed smokeless tobacco products can have an individual product friability of between 1.7 and 2.1 weight percent.

The preformed smokeless tobacco product, in some embodiments, has a three point bend strength of at least 0.25 N. In some embodiments, a plurality of preformed smokeless tobacco products within a container have an average three point bend strength of at least 0.25 N. In some embodiments, the three point bend strength of a single preformed smokeless tobacco product and/or the average three point bend strength for a plurality of preformed smokeless tobacco products is less than 4.0 N. In some embodiments, one or more preformed smokeless tobacco products have a three point bend strength of between 0.25 N and 0.8 N.

The preformed smokeless tobacco product, in some embodiments, has a texture profile hardness of at least 1.0 N. In some embodiments, a plurality of preformed smokeless tobacco products within a container has an average texture profile hardness of at least 1.0 N. In certain embodiments, the texture profile hardness of a single product and/or the average texture profile hardness for a plurality of products is at least 2.0 N. In some embodiments, the texture profile hardness of a single preformed smokeless tobacco product and/or the average texture profile hardness for a plurality of preformed smokeless tobacco products is less than 12.0 N. In some embodiments, one or more preformed smokeless tobacco products have a texture profile hardness of between 4.4 N and 8.0 N. In still further embodiments, one or more preformed smokeless tobacco products have a texture profile hardness of between 4.5 N and 5.5 N.

The shape of the preformed smokeless tobacco product can, for example, be square or rectangular-shaped, rounded-edge rectangular-shaped, elliptical-shaped, semi-circular, football-shaped, boomerang-shaped, teardrop-shaped, comma-shaped, bowtie-shaped, or peanut-shaped. In some embodiments, the shape can have a least one pair of opposing, generally parallel exterior surfaces. A pair of opposing, generally parallel exterior surfaces can be between 3 mm and 50 mm apart. For example, the generally parallel exterior surfaces may be between 5 and 10 mm apart. In certain embodiments, the shaped smokeless tobacco body has three pairs of opposing, generally parallel exterior surfaces. For example, the shape can be a substantially rectangular cuboidal shape. The substantially rectangular cuboidal shape can have a length of between 15 mm and 50 mm, a width of between 5 mm and 20 mm, and a thickness of between 3 mm and 10 mm. In some embodiments, the shape has a length of between 18 mm and 30 mm, a width of between 8 mm and 13 mm, and/or a thickness of between 6 mm and 11 mm.

In some embodiments, the one or more smokeless tobacco products include at least 0.5 weight percent of binder. The smokeless tobacco products can, in some embodiments, include less than 5.0 weight percent binder. In certain embodiments, the smokeless tobacco products include between 0.5 and 1.5 weight percent binder.

The binder can be a carbohydrate. In some embodiments, the binder includes a hydroxyl containing compound, a dextrin or dextrin derivative, carboxymethyl cellulose, hydroxypropyl cellulose, hydroxyethyl cellulose, hydroxypropyl methyl cellulose, methyl cellulose, konjac, collagen, inulin, soy protein, whey protein, casein, wheat gluten, carrageenan, alginates, propylene glycol alginate, xanthan, dextrin, pullulan, curdlan, gellan, locust bean gum, guar gum, tara gum, gum tragacanth, pectin, agar, zein, karaya, gelatin, psyllium seed, chitin, chitosan, gum acacia, polyvinyl pyrrolidone, polyethylene oxide, polyvinyl alcohol, or a combination thereof. In certain embodiments, the binder is selected from the group of guar gum, xanthan, cellulose, and combinations thereof. For example, the preformed smokeless tobacco products can include between 0.6 and 0.8 weight percent of a binder that includes guar gum, xanthan, and cellulose.

The tobacco, in some embodiments, is moist snuff. The tobacco can have a moisture content of at least 40 weight percent. In certain embodiments, the tobacco can include between 48 and 50 weight percent oven volatiles. The preformed smokeless tobacco products can, in some embodiments, have an oven volatiles content of between 50 and 61 weight percent (e.g., about 57 weight percent oven volatiles). In other embodiments, the tobacco can have a lower moisture content. For example, the total oven volatiles content for a preformed smokeless tobacco product can be between 10 and 30 weight percent.

In certain embodiments, the tobacco is long-cut tobacco. The tobacco can be fermented or non-fermented tobacco in fine cut or shredded leaf form. The tobacco can also be cured (e.g., air cured, fire cured, flue cured, etc.). The tobacco can include tobacco prepared from plants having less than 20 μg of DVT per $cm^2$ of green leaf tissue.

The one or more preformed smokeless tobacco products can include a flavorant. For example, the preformed smokeless tobacco product can include one or more of the following flavorants: licorice, wintergreen, cherry and berry type flavorants, Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, and mint oils from a species of the genus Mentha. In certain embodiments, the preformed smokeless tobacco products consist essentially of the tobacco, the binder, and optionally one or more flavorants, sweeteners, fillers, water, salt, and/or pH adjusters.

The container of the system can be a substantially cylindrical container. For example, the container can have a diameter of between five cm and eight cm and a height of between two cm and four cm. The container can include a plurality of the preformed smokeless tobacco products, each having a substantially similar shape and each comprising a similar individual product friability, three point bend strength, and/or texture profile hardness. In certain embodiments, the container can include other tobacco or tobacco related products. In some embodiments, all products within the container are the preformed smokeless tobacco products described herein.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
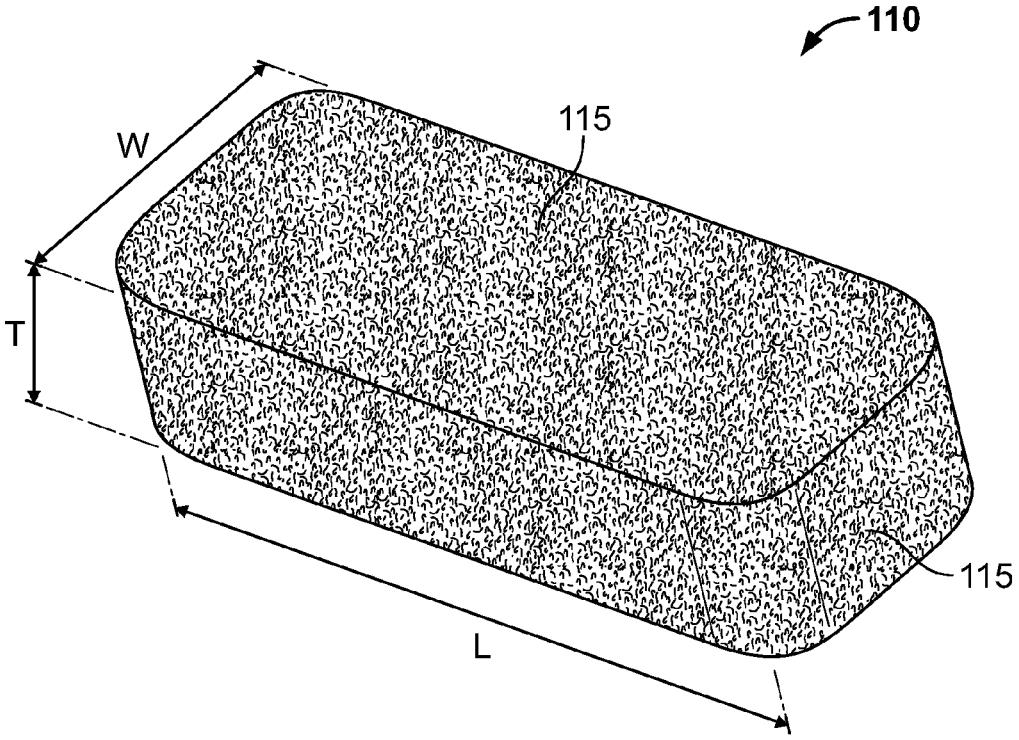
FIG. 1 depicts a perspective view of an embodiment of a preformed smokeless tobacco product with a predetermined shape.
Figure 2:
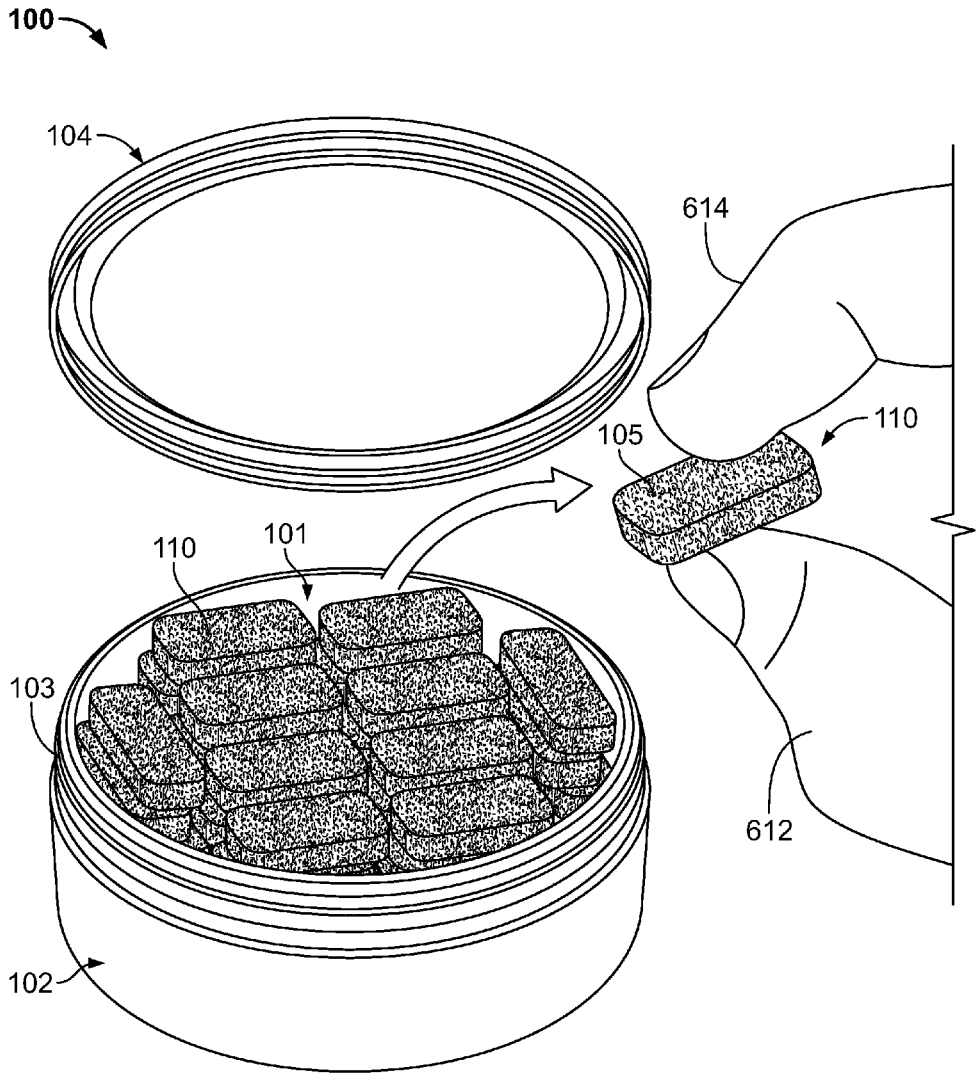
FIG. 2 depicts a substantially cylindrical container retaining a plurality of preformed smokeless tobacco products, each with a substantially similar shape.

Referring to FIGS. 1-2, some embodiments of a smokeless tobacco system 100 can include one or more preformed smokeless tobacco products 110 arranged in an interior space 101 of a container 102 that mates with a lid 104. Some embodiments of the preformed smokeless tobacco product 110 can include a smokeless tobacco 115 combined with one or more selected binders. The smokeless tobacco 115 and the one or more binders are compressed or molded into an adult tobacco consumer convenient shape prior to packaging so that a predetermined portion of the smokeless tobacco 115 is retained by the shaped product 110 yet still exposed on an exterior surface of the shaped product 110. As described in more detail below, the depicted embodiment of the smokeless tobacco product 110 can comprise a moist smokeless tobacco.

As described in more detail below, the preformed smokeless tobacco product 110 described herein may have a beneficial combination of material properties that enhance tobacco satisfaction with improved tactile and flavor benefits. For example, the preformed smokeless tobacco product 110 retains its shape during processing, shipping, and adult tobacco consumer handling, thus permitting an adult tobacco consumer to handle an individual preformed smokeless tobacco product without the product falling apart prior to use. In addition, each of the smokeless tobacco products 110 in the container 102 of the system 100 (FIG. 2) may have a substantially similar shape while also providing a substantially similar, predetermined portion of tobacco for an adult tobacco consumer. Accordingly, the system 100 enables an adult tobacco consumer to receive consistent portions of tobacco (e.g., with each selected product 110 in the mouth) while also experiencing the tactile and flavor benefits of having the smokeless tobacco externally exposed on the article (e.g., not retained inside a paper-like pouch or sachet). Additionally, in some embodiments, the binder employed in the smokeless tobacco product 110 can enhance the release and/or duration of flavors. This unique combination of handling properties, mouth feel, and flavor release can enhance tobacco satisfaction with improved tactile and flavor benefits.

Figure 4A:
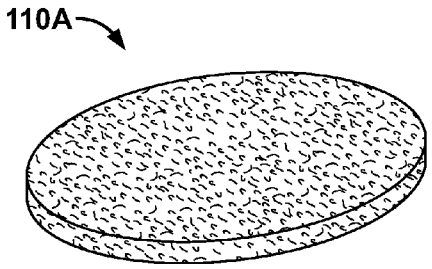
FIGS. 4A-4N depict alternative shapes for the preformed smokeless tobacco product.
Figure 4B:
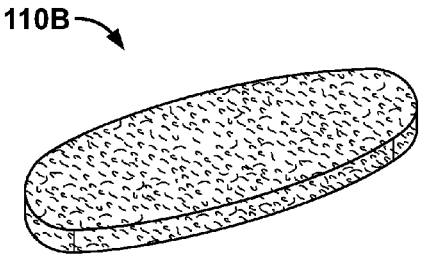
Figure 4C:
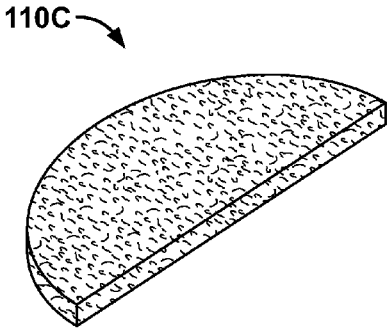
Figure 4D:
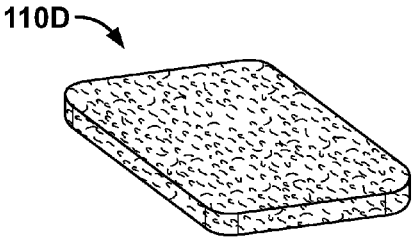
Figure 4E:
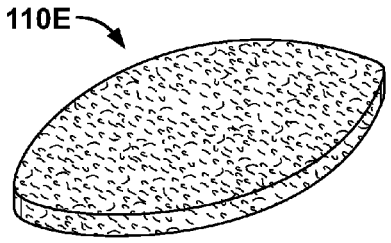
Figure 4F:
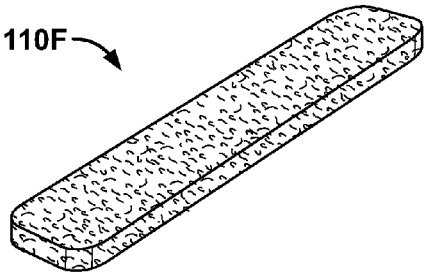
Figure 4G:
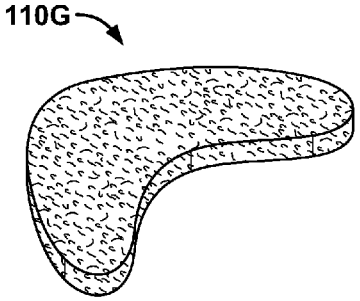
Figure 4H:
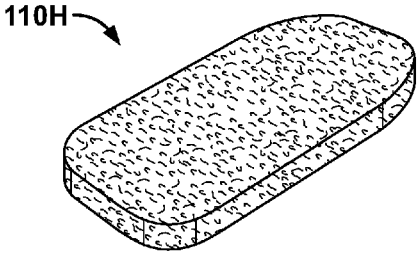
Figure 4I:
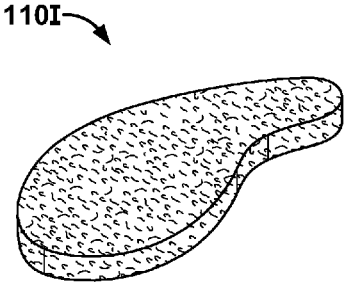
Figure 4J:
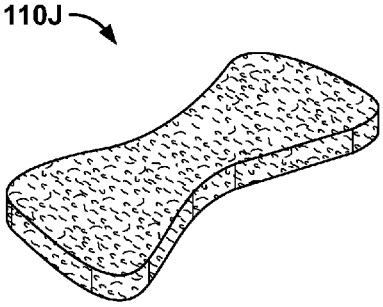
Figure 4K:
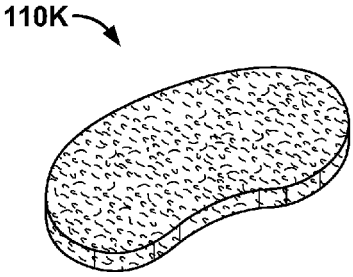
Figure 4L:
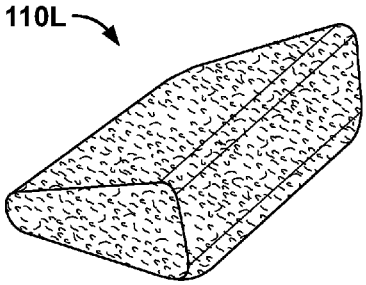
Figure 4M:
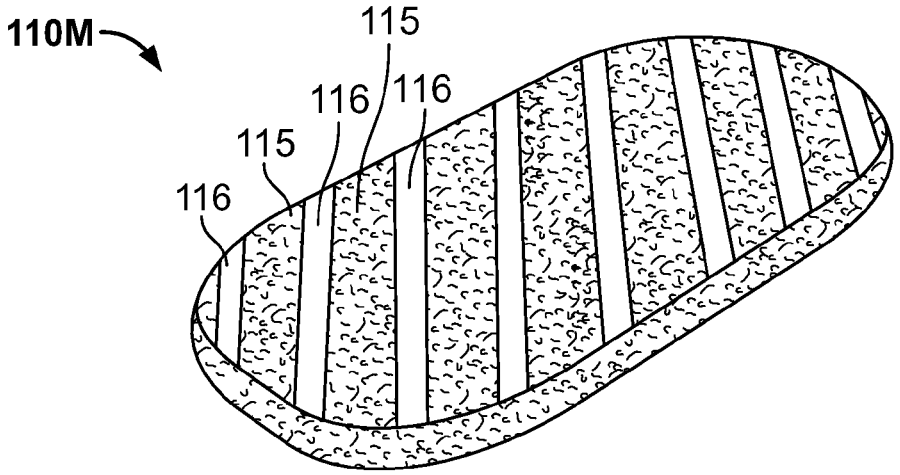
Figure 4N:
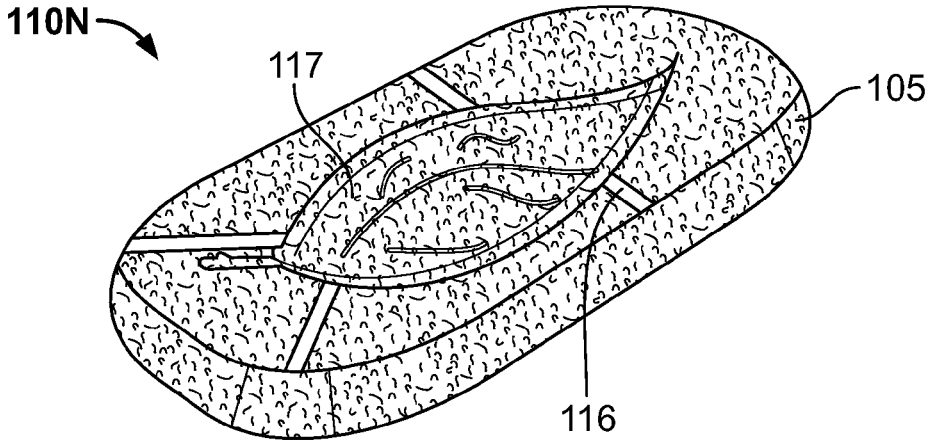

Referring to FIG. 1, each of the preformed smokeless tobacco products 110 can be compressed or otherwise molded into a selected shape that is beneficial for placement in an adult tobacco consumer while also exposing the tobacco 115 along one or more outer surfaces when the product 110 is inserted in the adult tobacco consumer. Different embodiments of the preformed smokeless tobacco product can have a variety of different specific combinations of ingredients. The ingredients determine, in part, the material properties described herein. The preformed smokeless tobacco products can also have a variety of shapes and dimensions. For example, FIG. 1 depicts an embodiment of a preformed smokeless tobacco product 110 having a substantially rectangular cuboidal shape in which the corners are rounded in a longitudinal plane. As such, as shown in FIG. 2, each of the preformed smokeless tobacco products 110 have a substantially similar shape. The shape can include at least one pair of opposing, generally parallel exterior surfaces, and as shown in the depicted embodiment, can include three pairs of opposing, generally parallel exterior surfaces. Other possible predetermined shapes are shown in FIGS. 4A-4N (described in more detail below). As used herein, "preformed" means the product is formed into a selected product shape at the time of or prior to the time of packaging. The term "preformed," however, does not exclude products that expand or deform into an altered shape after molding and/or packaging processes. For example, in some embodiments shaped smokeless tobacco bodies can expand into the preformed smokeless tobacco products after being deposited into a container.

The preformed smokeless tobacco can be formed into the selected shape by compressing a mixture including the tobacco 115 and at least one binder or binding agent into the desired product shape (e.g., in a mold). The shaping process, including the amount of compression, can also impact the material properties described herein. After shaping, a plurality of preformed smokeless tobacco products 110, each having a substantially similar shape, can be packaged together in the container 102 of the system 100 such that the interior space 101 is sealed at least in part by the lid 104.

Briefly, while in use, an adult tobacco consumer can remove one of the preformed smokeless tobacco products 110 from the interior space 101 of the container 102 and can place the selected product 110 in the adult tobacco consumer while the preformed smokeless tobacco product generally retains its preformed shape. A portion of the tobacco 115 is thereby placed in contact with tissue in the adult tobacco consumer's mouth. In some embodiments, the smokeless tobacco product 110 can maintain its cohesiveness within an adult tobacco consumer's mouth, thus reducing the likelihood of substantial portions of the tobacco 115 breaks away from the preformed shape and "floats" in the mouth, yet providing the adult tobacco consumer with the mouth feel and taste similar to loose moist smokeless tobacco.

Referring to FIG. 2 in more detail, the system 100 can be configured so that an adult tobacco consumer can readily grasp at least one of the preformed smokeless tobacco products 110 for placement in the adult tobacco consumer's mouth, thereby receiving a predetermined portion of tobacco. Each product 110 stored in the container has a generally consistent shape. Accordingly, the system 100 can permit an adult tobacco consumer to receive consistent portions of moist smokeless tobacco with each placement (e.g., with each deposit of the selected product 110 in the mouth), while also experiencing the tactile and flavor benefits of having the smokeless tobacco externally exposed on the exterior of the product 110. The container 102 and lid 104 can releasably mate at a connection rim 103 so as to maintain freshness and other product qualities of the preformed smokeless tobacco products 110 contained therein. Such qualities may relate to, without limitation, texture, flavor, color, aroma, mouth feel, taste, ease of use, and combinations thereof. In particular, the container 102 may have a generally cylindrical shape with a base and a cylindrical side wall that at least partially define the interior space 101. The interior space 101 can have an interior height and an interior diameter defining the dimensions of the interior space 101. The connection rim 103 can be formed on the container 102 to provide a snap-fit engagement with the lid 104.

The container 102 and lid 104 can be separated from one another so that the adult tobacco consumer can have access to the one or more preformed smokeless tobacco products 110 contained therein. Thereafter, the adult tobacco consumer can obtain a predetermined portion of the tobacco 115 by readily grasping any one of the preformed smokeless tobacco products 110 (e.g., without the need to estimate an amount of cut or shredded loose tobacco in a manual pinch). The remaining preformed smokeless tobacco products 110 can be enclosed in the container 102 when the lid 104 is reengaged with the container 102.

I. Material Properties

In some embodiments, the material properties of the preformed smokeless tobacco product 110 described herein can enhance tobacco satisfaction with improved tactile and flavor benefits. In particular, the material properties improve handling, mouth feel, and flavor release. In certain embodiments, the material properties of one or more of the preformed smokeless tobacco products 110 can be defined in terms of individual product friability, three point bend strength, and texture profile hardness.

Individual Product Friability

Friability is a measurement of the ability of an object to be reduced to smaller pieces when subjected to pressure or friction. A numerical value for friability is dependent on the specific test used. As used herein, "individual product friability" is the weight percent of material lost due to the placement of an individual product within a friability drum and rotated at 25 rpm for 100 revolutions, which is equal to four (4) minutes of rotation. A friability drum is a standard friability drum with a diameter of 152 mm. For example, a standard friability drum meeting USP, EUR, and DAB pharmacopoeia standards, such as the Erweka GmbH D63159 friability tester having a standard USP 100 Method friability drum, can be used to test the preformed smokeless tobacco product 110. In particular embodiments, a plurality of preformed smokeless tobacco products 110 have an average individual product friability of between 0.5 weight percent and 80 weight percent. The individual product friability of each preformed smokeless tobacco product 110 is, in some embodiments, between 1.0 weight percent and 10 weight percent. For example, the individual product friability of each preformed smokeless tobacco product 110 can be between 1.7 weight percent and 2.1 weight percent.

The preformed smokeless tobacco product 110 can have an individual product friability of less than 80 weight percent to increase the likelihood that each of the products 110 can be packaged, shipped, stocked, purchased, carried, and handled prior to use without significantly falling apart or otherwise significantly deteriorating from its original shape and tobacco content. After packaging, the container 102 retaining each preformed smokeless tobacco product 110 may be subjected to rotated, being dropped or otherwise moved around in a jarring manner during shipping and stocking of the product. Adult tobacco consumers may also move the container 102 in a jarring manner during ordinary usage. Moreover, the plurality of preformed tobacco products 110 in the container 102 may shift and move against each other during any jarring movement. Additionally, as products 110 are individually removed from the container 102, the risk of fragmenting increases as the remaining preformed smokeless tobacco products 110 have more room for motion relative to the container 102 within the interior space 101. In some embodiments, the preformed smokeless tobacco product 110 has an individual product friability of less than 60 weight percent. The preformed smokeless tobacco product 110 can also have an individual product friability of less than 50 weight percent. In some embodiments, the preformed smokeless tobacco product 110 has an individual product friability of less than 40 weight percent. In still other embodiments, the preformed smokeless tobacco product 110 has an individual product friability of less than 30 weight percent. In still other embodiments, the preformed smokeless tobacco product 110 has an individual product friability of less than 20 weight percent. The preformed smokeless tobacco product 110 can also have an individual product friability of less than 10 weight percent. The individual product friability of each preformed smokeless tobacco product 110 can also be less than 7 weight percent. In some embodiments, the individual product friability of each preformed smokeless tobacco product 110 is less than 4 weight percent. For example, the individual product friability of each preformed smokeless tobacco product 110 can be less than 2.1 weight percent.

The preformed smokeless tobacco product 110 may have an individual product friability of at least 0.5 weight percent to increase the likelihood of a good mouth feel and flavor release. Although a non-friable product (e.g., a product having an individual product friability of approximately zero) can be placed in an adult tobacco consumer's mouth, a non-friable product does not provide a mouth feel or flavor release that is similar to loose smokeless tobacco. Accordingly, in particular embodiments, an individual product friability of at least 0.5 weight percent can allow the product to partially conform to the contours of an adult tobacco consumer's mouth (e.g., to the contours between a lip and a gingiva). An individual product friability of at least 0.5 weight percent can also permit different portions of the tobacco within the product to make contact with the adult tobacco consumer's oral cavity. In some embodiments, the preformed smokeless tobacco product 110 has an individual product friability of at least 1.0 weight percent. In still other embodiments, the preformed smokeless tobacco product 110 has an individual product friability of at least 1.5 weight percent. For example, the individual product friability of each preformed smokeless tobacco product 110 can be greater than 1.7 weight percent.

Three Point Bend Strength

Three Point Bend ("TPB") strength is a measurement of the force required to break a shaped smokeless tobacco body into two or more pieces. The TPB strength is determined using a TPB test. The TPB test places a shaped smokeless tobacco body lengthwise across two supports. The shaped smokeless tobacco body has a length (e.g., a maximum dimension). The supports are spaced at a distance that is approximately half of the length of the shaped smokeless tobacco body. Accordingly, the spacing between supports is adjusted depending on the length of the shaped smokeless tobacco body being tested. The lengthwise midpoint of the shaped smokeless tobacco body is positioned at the midpoint of the distance between the two supports. During the TPB test, an angled compression jig presses against the lengthwise midpoint of the shaped smokeless tobacco body with increasing force using a stroke rate of 155 mm/minute. The angled compression jig has a 2 mm thickness and a 50 mm width. The TPB strength is the force used with the angled compressing jig that causes the shaped smokeless tobacco body to break.

As used herein, "three point bend strength" is the force required to break the product using the TPB test described herein. In some embodiments, the preformed smokeless tobacco product 110 described herein can have a TPB strength of at least 0.25 N to reduce the likelihood that the product 110 falls apart prior to oral usage. In some embodiments, the preformed smokeless tobacco product 110 has a TPB strength of less than 4.0 N. In some embodiments, the preformed smokeless tobacco product 110 has a TPB strength of less than 2.0 N. In some embodiments, the preformed smokeless tobacco product 110 has a TPB strength of between 0.25 N and 0.8 N.

Hardness

A hardness measurement can be used to describe the force required to deform the preformed smokeless tobacco product 110. For example, a tensile profile hardness test can measure hardness by creating a particular indentation by pressing a sphere into the tested sample. The Hardness measurement can be a component of the Texture Profile Analysis (TPA) test that is sometimes used to evaluate various consumer products. The TPA test is performed by placing the sample on a flat surface (side with largest surface facing down) and compressing the sample with a 10 mm round ball fixture 3.5 mm (50% of sample thickness) into the sample surface. Once the 3.5 mm depth is achieved, the compression jig is immediately raised at the same stroke speed to the zero-stroke position (the starting position). The compression fixture is then lowered to repeat the exact same compression sequence a second time. The load applied to the round ball compressing jig is increased until an indentation of 3.5 mm is made. Between compression events, the compressing jig is held at the zero-stroke position for 30 seconds. As used herein, "texture profile hardness" is the maximum force achieved during an initial process of pressing a 10 mm round ball compression jig (e.g., of stainless steel) 3.5 mm into the surface of a sample for a 30 second hold time using a stroke rate of 50 mm/min. The forces measured during the second compression of a TPA test are compared to the forces achieved during the first compression to calculate the additional metrics of springiness and cohesiveness.

In particular embodiments, the preformed smokeless tobacco product 110 can have a texture profile hardness of at least 2.0 to reduce the likelihood that the product 110 substantially deforms in response to jarring movements of the container 102. In some embodiments, the preformed smokeless tobacco product 110 has a texture profile hardness of at least 4.0 N. In still other embodiments, the preformed smokeless tobacco product 110 has a texture profile hardness of at least 4.5 N. The texture profile hardness can also be greater than 5.0 N.

The preformed smokeless tobacco product 110 can have a texture profile hardness of less than 12.0 N to increase the likelihood that each product 110 can be readily conformed to surfaces within an adult tobacco consumer's mouth. For example, after insertion of the product 110 into the mouth, the adult tobacco consumer can press the preformed smokeless tobacco product 110 between a lip and the gingiva to conform the product 110 to the contours of the gingiva and the lip. In some embodiments, the preformed smokeless tobacco product 110 has a texture profile hardness of less than 8.0. The texture profile hardness of each preformed smokeless tobacco product 110 can also be less than 5.5. For example, the preformed smokeless tobacco product 110 can have a texture profile hardness of between 4.5 N and 5.5 N to balance the need to have a product that retains its shape during transport but one that can also be readily reshaped after placement in an adult tobacco consumer's mouth.

II. Product Constituents

Some embodiments of the preformed smokeless tobacco product 110 include tobacco and a binder. The product 110 can optionally include one or more flavorants and other additives. The particular composition may, in part, determine the material properties of the preformed smokeless tobacco product 110.

Tobacco

The tobacco is any tobacco suitable for use in the smokeless tobacco product 110. By "tobacco" it is meant a part, e.g., leaves, flowers, and stems, of a member of the genus *Nicotiana*. Exemplary species of tobacco include *N. rustica, N. tabacum, N. tomentosiformis*, and *N. sylvestris*. Suitable tobaccos include fermented and unfermented tobaccos, dark air-cured, dark fire-cured, burley, flue cured, and cigar filler or wrapper, as well as the products from the whole leaf stemming operation. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in *Tobacco: Production, Chemistry and Technology*, Davis & Nielsen, eds., Blackwell Publishing, Oxford). Cured, or cured and fermented tobacco can be further processed (e.g., cut, expanded, blended, milled or comminuted) prior to incorporation into a preformed smokeless tobacco product. The tobacco, in some embodiments, is cured long cut fermented moist tobacco having an oven volatiles content of between 48 and 50 weight percent prior to mixing with the binder and optionally flavorants and/or other additives.

The tobacco can, in some embodiments, be prepared from or include leaf tobacco from tobacco plants having less than 20 μg of DVT per $cm^2$ of green leaf tissue. For example, the tobacco can be selected from the tobaccos described in U.S. Patent Publication No. 2008/0209586, which is hereby incorporated by reference. Tobacco compositions containing tobacco from such low-DVT varieties exhibit improved flavor characteristics in sensory panel evaluations when compared to tobacco or tobacco compositions that do not have reduced levels of DVTs.

Binder

Binders suitable for use in the preformed smokeless tobacco product described herein include orally compatible polymers, such as cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)); natural polymers (e.g., starches and modified starches, konjac, collagen, inulin, soy protein, whey protein, casein, and wheat gluten); seaweed-derived polymers (e.g., carrageenan (kappa, iota, and lambda); alginates, (and propylene glycol alginate), microbial-derived polymers (e.g., xanthan, dextrin, pullulan, curdlan, and gellan); extracts (e.g., locust bean gum, guar gum, tara gum, gum tragacanth, pectin (lo methoxy and amidated), agar, zein, karaya, gelatin, psyllium seed, chitin, and chitosan), exudates (e.g., gum acacia (arabic) and shellac), synthetic polymers (e.g., polyvinyl pyrrolidone, polyethylene oxide, and polyvinyl alcohol)).

The binder, in some embodiments, is guar gum, xanthan, cellulose, or a combination thereof. The cellulose can be carboxymethyl cellulose (CMC). Guar gum, xanthan, CMC, and some combinations thereof can be obtained from, for example, TIC Gums Inc., located in White Marsh, Md. and at www.ticgums.com. Guar gum is sold by TIC Gums Inc. under the trade name GUARNT. Carboxymethyl cellulose (CMC) is sold by TIC Gums Inc. under the trade name TICALOSE. Xanthan is sold by TIC Gums Inc. under the trade name TICAXAN. TIC Gums Inc. also sells some mixed binders, such as the mixed binder systems sold under the trade names TICALOID and TICAFILM. In some embodiments, TICALOID LITE Powder is used as the binder in the preformed smokeless tobacco products.

The binder can be present in amounts that allow the preformed smokeless tobacco product 110 to have the material properties described herein. The specific amount of binder used to achieve the particular material properties can depend, in part, on the type of binder used. In some embodiments, the preformed smokeless tobacco product 110 includes at least 0.5 weight percent binder, which can increase the likelihood that the preformed smokeless tobacco product 110 maintains its integrity during packaging and transport. The preformed smokeless tobacco product 110 has, in some embodiments, less than 5.0 weight percent binder. In some embodiments, the binder of each preformed smokeless tobacco product 110 is between 0.5 and 2.0 weight percent of the preformed smokeless tobacco product. The binder of each preformed smokeless tobacco product 110 can also be in an amount of between 0.5 and 1.5 weight percent.

Flavorants and Other Components

In some embodiments, the preformed smokeless tobacco product 110 can optionally include one or more flavorants. For example, suitable flavorants include wintergreen, cherry and berry type flavorants, various liqueurs and liquors such as Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, liquorish, and mint oils from a species of the genus Mentha. Mint oils useful in particular embodiments of the preformed smokeless tobacco product 110 include spearmint and peppermint.

The preformed smokeless tobacco product 110 may optionally include other additives. Other additives include fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer. Water and other oven volatiles can also be added during a mixing process (discussed below) to alter the total oven volatiles content of the formed smokeless tobacco product 110. Various salts can also be added.

The type and amount of flavorants and other additives can also impact the material properties of the preformed smokeless tobacco product. In some embodiments, the amount of flavorants and other additives in the preformed smokeless tobacco product 110 are limited to less than 10 weight percent in sum. In some embodiments, the amount of flavorants in the preformed smokeless tobacco product 110 are limited to be less than 5 weight percent in sum. For example, certain flavorants can be included in the preformed smokeless tobacco product 110 in amounts of about 3 weight percent.

In some embodiments, the combination of tobacco, flavorants, and other additives used in the preformed smokeless tobacco product 110 can be the mixture of tobacco, flavorants, and other additives commercially sold as smokeless tobacco. For example, the finished tobacco can be the same as the finished smokeless tobacco sold under the trade name SKOAL (e.g., SKOAL Long Cut), which includes flavorants and other additives.

Oven Volatiles

Some embodiments of the preformed smokeless tobacco product 110 can have a total oven volatiles content of between 10 and 61 weight percent. The oven volatiles include water and other volatile compounds, which can be a part of the tobacco, the binder, the flavorants, and/or other additives. As used herein, the "oven volatiles" are determined by calculating the percentage of weight loss for a sample after drying the sample in a pre-warmed forced draft oven at 110° C. for 3.25 hours. The binder may absorb some of the oven volatiles during the mixing process and forming process. In some embodiments, the oven volatiles content of the preformed smokeless tobacco product 110 is between 50 and 61 weight percent. For example, the oven volatiles content of each preformed smokeless tobacco product 110 can be about 57 weight percent. In other embodiments, the oven volatiles content can be between 10 and 30 weight percent.

III. Making & Packing

Figure 3:
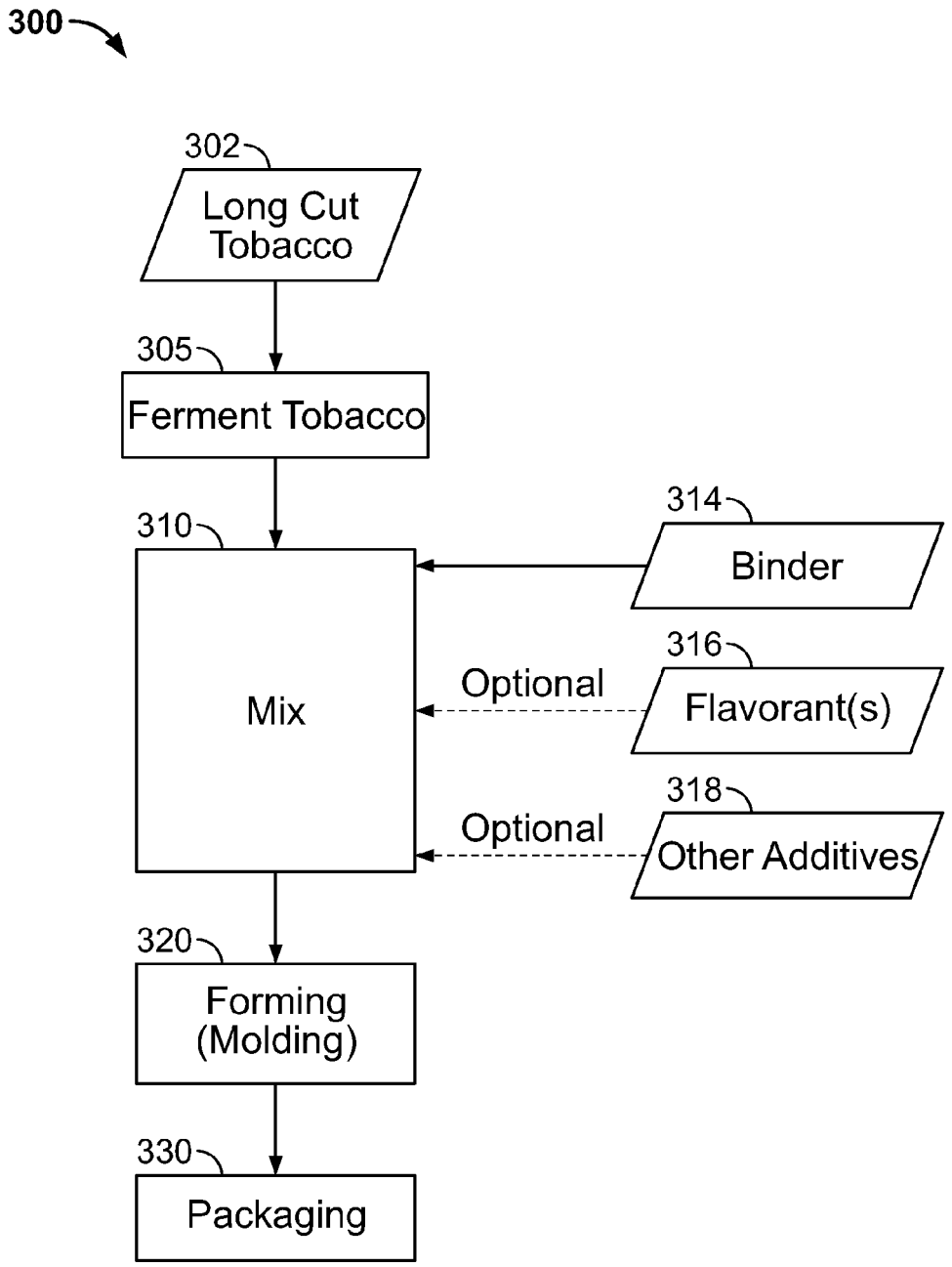
FIG. 3 is a flow chart showing an exemplary method of forming shaped smokeless tobacco bodies.

Referring now to FIG. 3, some embodiments of the method of making the preformed smokeless tobacco product 110 can include mixing the tobacco, the binder, and any flavorants or other additives and shaping the mixture into the predetermined shape. The particular shaping process used can impact the material properties described herein. In particular, the uniformity of the mixing and the amount of compression imparted to the mixture can impact the integrity of the preformed smokeless tobacco product 110 and thus impact the individual product friability, texture profile hardness, and three point bend strength.

FIG. 3 is a flow chart 300 showing an example of how the preformed smokeless tobacco product can be made and packaged. In some embodiments, the tobacco can be cured tobacco. Tobacco 302 can be fermented in step 305 and added to a mixer. A binder 314, and optionally flavorants 316 and/or other additives 318 are mixed with the tobacco 302 in mixing step 310. For example, tobacco 302 can be long cut tobacco having an oven volatiles content of 48-50 weight percent. The binder 314 can be TICALOID LITE Powder. The flavorants 316 and other additives 318 can include, for example, a mint flavoring, a sweetener, and a pH modifier. The mixing step 310 can occur in any commercially available countertop mixer or industrial mixer, for example a HOBART 40 lbs mixer or a FORBERG 250 lbs Paddle Mixer. Water can be added to the tobacco prior to or during the mixing process to alter the total oven volatiles content of the final smokeless tobacco product. The oven volatiles content can also be modified by heating the mixture. In other embodiments, a commercially available smokeless tobacco product (e.g., SKOAL Long Cut) can be mixed with a binder (e.g., TICALOID LITE Powder) to form the mixture.

The forming step 320 can include depositing the mixture into a mold. In some embodiments, the mixture is deposited into an open mold plate including a plurality of identically shaped cavities. The forming step 320 can include applying pressure to the mixture. The pressure can be applied as injection pressure applied to the mixture as it is forced into a closed cavity or by compressing each cavity filled with the mixture. The pressure used during the molding process impacts that amount of compression experienced by the mixture and thus the material properties of the mixture. In some embodiments, 50-300 lbs of injection pressure is used to deliver the mixture into a plurality of mold cavities. The molds can be filled with continuous or intermittent pressure. A screw pump can be used to apply the pressure to the mixture. For example, a Formax® machine (e.g., the FORMAX F-6 and F-19 units) can be used to inject the mixture into cavities in a mold plate. In some embodiments, the mold cavities have shapes corresponding to the preformed product shapes 110 shown in FIGS. 1, and 4A-4N. In some embodiments, the mold cavities have a volume sized to create formed shaped smokeless tobacco bodies 110 having a mass of about 2.35 grams. The edges and corners of the mold can be rounded to permit the formed shaped smokeless tobacco body to be easily released from the mold.

The packaging step 330 includes separating the formed shaped smokeless tobacco bodies 110 from the mold cavity and depositing the formed shaped smokeless tobacco bodies into a container 102. For example, mold plates can be separated and the formed shaped smokeless tobacco bodies can be deposited either directly into a bottom portion of a container 102 or on to an indexing conveyor. An indexing conveyor can be used to eliminate shaped smokeless tobacco bodies that do not conform to quality control standards before the remaining products are placed in the container 102. In some embodiments, products 110 can be tightly packed by arranging the formed shaped smokeless tobacco bodies 110 to be side by side in an organized manner inside the container 102. For example, each of a plurality of formed shaped smokeless tobacco bodies can be oriented in the same direction inside the container. In some embodiments, the shaped smokeless tobacco bodies can be organized and packed in layers. Each layer could have each formed shaped smokeless tobacco body 110 oriented in the same direction, but the different layers could be oriented in different directions. Separators (e.g., wax paper) could be used to separate adjacent layers.

After being placed in the interior space 103 of container 102, a lid 104 is mated with the connection rim 103 of the container 102. A label can be applied to the closed container system 100 (e.g., applied to the outer cylindrical sidewalls of the container 102 and the lid 104). Shrink wrap can also be applied to the closed container system 100. A plurality of filled, labeled, and shrink wrapped container systems 100 can then be placed in a box and shipped to a retail location.

Each preformed smokeless tobacco product 110 can experience significant jarring movements during the steps of removing the formed shaped smokeless tobacco bodies 110 from the mold cavities, sorting and placing the formed shaped smokeless tobacco bodies 110 into a container 102, closing, labeling, shrink wrapping, and bulk packaging the container 210, shipping containers to retail locations, stocking the containers at a retail location, and having an adult tobacco consumer purchase and carry around the container. Accordingly, the composition, shape, and forming process are selected such that each preformed smokeless tobacco product 110 has the material properties described herein, which increases the likelihood that the integrity of each preformed smokeless tobacco product is maintained until adult tobacco consumer use.

VI. Packages and Shapes

As previously described, the preformed smokeless tobacco product can be compressed or otherwise molded into a predetermined shape prior to packaging the products 110 within the container 102. The particular shape can impact the material properties as described herein. For example, the length, width, and thickness of the product 110 can impact the Three Point Bend test. For the embodiment depicted in FIG. 1, the term "length" refers to the longest dimension L of the preformed smokeless tobacco product 110, the term "thickness" refers to the shortest dimension T of the preformed smokeless tobacco product 110, and the term "width" refers to the dimension W generally perpendicular to both the length and the thickness. As previously described, FIG. 1 depicts a perspective view of the preformed smokeless tobacco product 110 having a substantially rectangular cuboidal shape with rounded corners in the longitudinal (lengthwise) plane. In some embodiments, the preformed smokeless tobacco product has a substantially rectangular cuboidal shape having a length L of between 15 mm and 50 mm, a width W of between 5 mm and 20 mm, and a thickness T of between 3 mm and 10 mm. For example, a substantially rectangular cuboidal shape could have a length L of between 26 mm and 30 mm, a width W of between 10 mm and 12 mm, and a thickness T of between 6 mm and 8 mm. A product having a length of 28 mm, a width of 11 mm, and thickness of 7 mm could have a product weight of about 2.35 g. In other embodiments, a substantially rectangular cuboidal shape could have a length L of between 18 and 21 mm, a width W of between 10 mm and 12 mm, and a thickness T of between 9 mm and 11 mm. In other embodiments, the preformed smokeless tobacco product 110 can be cube shaped.

In some embodiments, the combination of the package dimensions and materials and the dimensions and materials of the plurality of preformed smokeless tobacco products 110 within the container 102 can impact the degree of damage sustained by the products 110 within the container 102 during transport of the container 102 from place to place (e.g., from factory to store to adult tobacco consumer). Moreover, as products are removed from the container 102, the amount of damage sustained by the individual products 110 can change. For example, additional space within the package can provide space permitting the products 110 to move around more relative to the container 102. The amount of damage sustained by products 110 within a container 102 due to movement of the package can be characterized using a whole package friability test. As used herein, "whole package friability" is the average weight percent of material lost from the products 110 within a container 102 due to the placement of the container 102 containing the plurality of products within a friability drum and rotated at 25 rpm for 100 revolutions, which is equal to four minutes of rotation. As previously discussed herein, the friability drum is a standard friability drum having a diameter of 152 mm. Because the container 102 can protect the products and/or cause the products to impact each other, the whole package friability can differ significantly from the individual product friability of the products 110 within the container 102. In particular embodiments, the packaged system of preformed smokeless tobacco products 100 has a whole package friability of less than 20 weight percent, less than 10 weight percent, less than 5 weight percent, or less than 1 weight percent.

In some embodiments, the preformed smokeless tobacco products 110 can form a single layer in the container 102. For example, each of the preformed smokeless tobacco products 110 can have a thickness that is at least 50% of an interior height of the container (i.e., the distance between the inner bottom wall of the container and the inner surface of a lid when the container is closed). In some embodiments, the thickness of the preformed smokeless tobacco products 110 is between at least 60%, at least 70%, at least 80%, at least 90%, or at least 95% of the interior height of the container 102. As shown, the preformed smokeless tobacco products have a thickness that is less than five mm less than the interior height of the container 102.

Referring now to FIGS. 4A-4N, the preformed smokeless tobacco product 110 can be compressed into any shape that would be desirable for smokeless tobacco users. For example, referring to FIGS. 4A-4K, the preformed smokeless tobacco product 110A-K can be formed in a shape that promotes improved oral positioning for the adult tobacco consumer, improved packaging characteristic, or both. In some circumstances, the preformed smokeless tobacco product 110A-K can be configured to be: (A) an elliptical-shaped preformed smokeless tobacco product 110A; (B) an elongated elliptical-shaped preformed smokeless tobacco product 110B; (C) semi-circular preformed smokeless tobacco product 110C; (D) square or rectangular-shaped preformed smokeless tobacco product 110D; (E) football-shaped preformed smokeless tobacco product 110E; (F) elongated rectangular-shaped preformed smokeless tobacco product 110F; (G) boomerang-shaped preformed smokeless tobacco product 110G; (H) rounded-edge rectangular-shaped preformed smokeless tobacco product 110H; (I) teardrop- or comma-shaped preformed smokeless tobacco product 110I; (J) bowtie-shaped preformed smokeless tobacco product 110J; and (K) peanut-shaped preformed smokeless tobacco product 110K. Alternatively, the preformed smokeless tobacco product can have different thicknesses or dimensionality, such that a beveled article (e.g., a wedge) is produced (see, for example, product 110L depicted in FIG. 4L) or a hemi-spherical shape is produced.

In addition or in the alternative to the flavor agents previously described, flavors can be included at many different places in the process. For example, referring to FIG. 4M, for example, some embodiments of a preformed smokeless tobacco product 110M can be equipped with flavors, in the form of flavor strips 116. The flavor strips 116 can be layered within the tobacco 115 such that both the tobacco 115 and the flavor strips 116 are exposed along exterior surfaces of the product 110M.

Referring to FIG. 4N, particular embodiments of the preformed smokeless tobacco product can be embossed or stamped with a design (e.g., a logo, an image, or the like). For example, the preformed smokeless tobacco product 110N can be embossed or stamped with any type of design 117 including, but not limited to, a trademark, a product name, or any type of image. The design 117 can be formed directly into the tobacco 105, arranged along the exterior of the product 110N. The design 117 can also be embossed or stamped into those embodiments with a dissolvable film 116 applied thereto.

Similar to previously described embodiments, the preformed smokeless tobacco product 110A-N depicted in FIGS. 4A-4N can be configured to include a predetermined portion of tobacco 115, and the tobacco 115 can be exposed along a number of exterior surfaces of the product 110A-N. Furthermore, products 110A-N can be packaged in a container 102 with a lid 104 (FIG. 2) along with a plurality of similarly shaped preformed smokeless tobacco products so that an adult tobacco consumer can conveniently select any of the similarly shaped products therein for oral use and receive a substantially identical portion of the tobacco 115. In some embodiments, the preformed smokeless tobacco product 110 or products 110A-N can be wrapped or coated in an edible or dissolvable film, which may be substantially transparent or translucent. The dissolvable film can readily dissipate when the product 110 is placed in an adult tobacco consumer's mouth thereby providing the adult tobacco consumer with the tactile feel of the tobacco 115 along the exterior of the product 110.

VII. Method of Use

Referring back to FIG. 2, the preformed smokeless tobacco product 110 can be used by removing a preformed smokeless tobacco product 110 from the container 102 and by placing the intact preformed smokeless tobacco product in the adult tobacco consumer's mouth. For example, the adult tobacco consumer can open the container 102 by removing the lid 104. When the adult tobacco consumer removes a preformed smokeless tobacco product 110 from the interior space 103 of the container 102, the adult tobacco consumer can grip the preformed smokeless tobacco product 110 between the adult tobacco consumer's thumb 612 and the index finger 614 and/or other fingers. The preformed smokeless tobacco product 110 retains its integrity as it is gripped with moderate pressure. The product 110 can also be broken into separate pieces if the adult tobacco consumer desires to have a smaller-sized portion of smokeless tobacco.

The adult tobacco consumer can insert the preformed smokeless tobacco product 110 into the adult tobacco consumer's mouth. For example, the adult tobacco consumer can place the preformed smokeless tobacco product 110 between the adult tobacco consumer's lip and the adult tobacco consumer's gingiva (the adult tobacco consumer's gums). Because of the material properties described herein, the product 110 retains its integrity during the gripping and inserting process. After the product 110 is inserted in the mouth, however, the product 110 comes into contact with the inside of the adult tobacco consumer's mouth. The adult tobacco consumer can also apply pressure to the preformed smokeless tobacco product 110 to conform the smokeless tobacco product to the contours of the oral cavity. For example, the adult tobacco consumer can compress the preformed smokeless tobacco product between the lip and the gingiva. Pressing the smokeless tobacco product can also loosen the tobacco and permit direct contact with different portions of the smokeless tobacco product, thus retaining the flavor and mouth feel experience of loose smokeless tobacco. Even as the smokeless tobacco product loosens in the adult tobacco consumer's mouth, however, the smokeless tobacco product can retain some cohesion and thus reduce the instances of substantial pieces of tobacco floating to undesired portions of the adult tobacco consumer's mouth. Moreover, the presence of the binder in the preformed smokeless tobacco product, however, can also enhance the flavor experience by increasing the duration of the flavor release as compared to loose smokeless tobacco.

VIII. Examples and Comparisons

Table I and FIGS. 5A-5D include the results of experimental samples using various and dissimilar binders, amounts of binders, molding processes, oven volatile contents, and product thicknesses.

TABLE I

| Sample | Molding Process | Intermittent | Binder | Total Binder | Average Sample Thickness | Average Individual product friability | Average Hardness | Average Three Point Bend | Oven Volatiles (%) |
|---|---|---|---|---|---|---|---|---|---|
| Ex 1 | Closed (F-6) | N/A | Ticaloid ® LITE Powder | 0.66% | 6.82 | 1.50% | 4.56 | 0.31 | 57 |
| Ex 2 | Closed (F-19) | Yes | Ticaloid ® LITE Powder | 0.66% | 6.87 | 2.13% | 4.99 | 0.32 | 57 |
| Ex 3 | Closed (F-19) | No | Ticaloid ® LITE Powder | 1.50% | 6.37 | 1.23% | 6.76 | 0.61 | 57 |
| Ex 4 | Closed (F-19) | Yes | Ticaloid ® LITE Powder | 1.50% | 6.6 | 1.53% | 7.12 | 0.57 | 57 |
| Ex 5 | Closed (F-19) | Yes | Ticaloid ® LITE Powder | 1.00% | 6.54 | 1.56% | 6.65 | 0.44 | 57 |
| Ex 6 | Closed (F-19) | No | Ticaloid ® LITE Powder | 1.00% | 6.68 | 1.97% | 6.71 | 0.38 | 57 |
| Ex 7 | Closed (F-19) | Yes | Guar Gum | 0.50% | 6.83 | 2.03% | 5.41 | 0.25 | 57 |
| Ex 8 | Closed (F-19) | Yes | Ticaloid ® LITE Powder (0.66%) & Ticafilm ® (1.0%) | 1.66% | 6.69 | 1.76% | 5.24 | 0.51 | 57 |
| Ex 9 | Closed (F-19) | Yes | Ticaloid ® LITE Powder | 0.66% | 6.68 | 2.37% | 4.48 | 0.22 | 59 |
| Ex 10 | Closed (F-19) | Yes | Ticaloid ® LITE Powder | 0.66% | 6.62 | 2.94% | 2.7 | 0.2 | 61 |
| Ex 11 | Open | N/A | Guar Gum | 1.75% | 7.66 | 7.12% | 10.5 | 0.29 | 57 |
| Ex 12 | Open | N/A | Xanthan Gum | 2.00% | 7.19 | 34.72% | 10.55 | 0.25 | 57 |
| Ex 13 | Open | N/A | Xanthan Gum (1.0%) and Guar Gum (1.0%) | 2.00% | 6.87 | 14.13% | 6.31 | 0.19 | 57 |
| Ex 14 | Open | N/A | Cellulose (1.5%) and Guar Gum (0.5%) | 2.00% | 6.85 | 23.21% | 5.2 | 0.15 | 57 |
| Ex 15 | Open | N/A | Ticaloid ® LITE Powder | 0.66% | 7.6 | 28.45% | 7.89 | 0.23 | 57 |

Different processing conditions were used for Examples 1-15. Examples 1-10 were shaped in a closed molding system, particularly the Formax® commercial processors. Example 1 was formed using the F-6 FORMAX commercial processor, while Examples 2-10 were formed using the F-19 FORMAX commercial processor. The F-19 FORMAX commercial processor allows for intermittent or non-intermittent flow.

During use, the F-6 FORMAX commercial processor was set at 20 strokes per minute, a 50% screw feed, and 125 lbs of pressure, with the use of the double pump. During use, the F-19 FORMAX commercial processor was set at 40-70 strokes per minute, a 50% screw feed, and 140 lbs of pressure, with the intermittent setting on. Examples 11-15 were shaped using a CORIO open mold, which applies very little compression to the mixtures.

Each sample was shaped to have a substantially rectangular cuboidal shape with a weight of about 2.25 grams. The thicknesses of each sample is shown in Table I and in FIG. 5A. As discussed above, the dimensions of the preformed smokeless tobacco product can impact the material properties described herein. Fourteen samples of each example composition and forming process were made and measured. The average measurement is shown in Table I and in FIG. 5A. Each sample was within the range of about six mm to about eight mm.

Figure 5A:
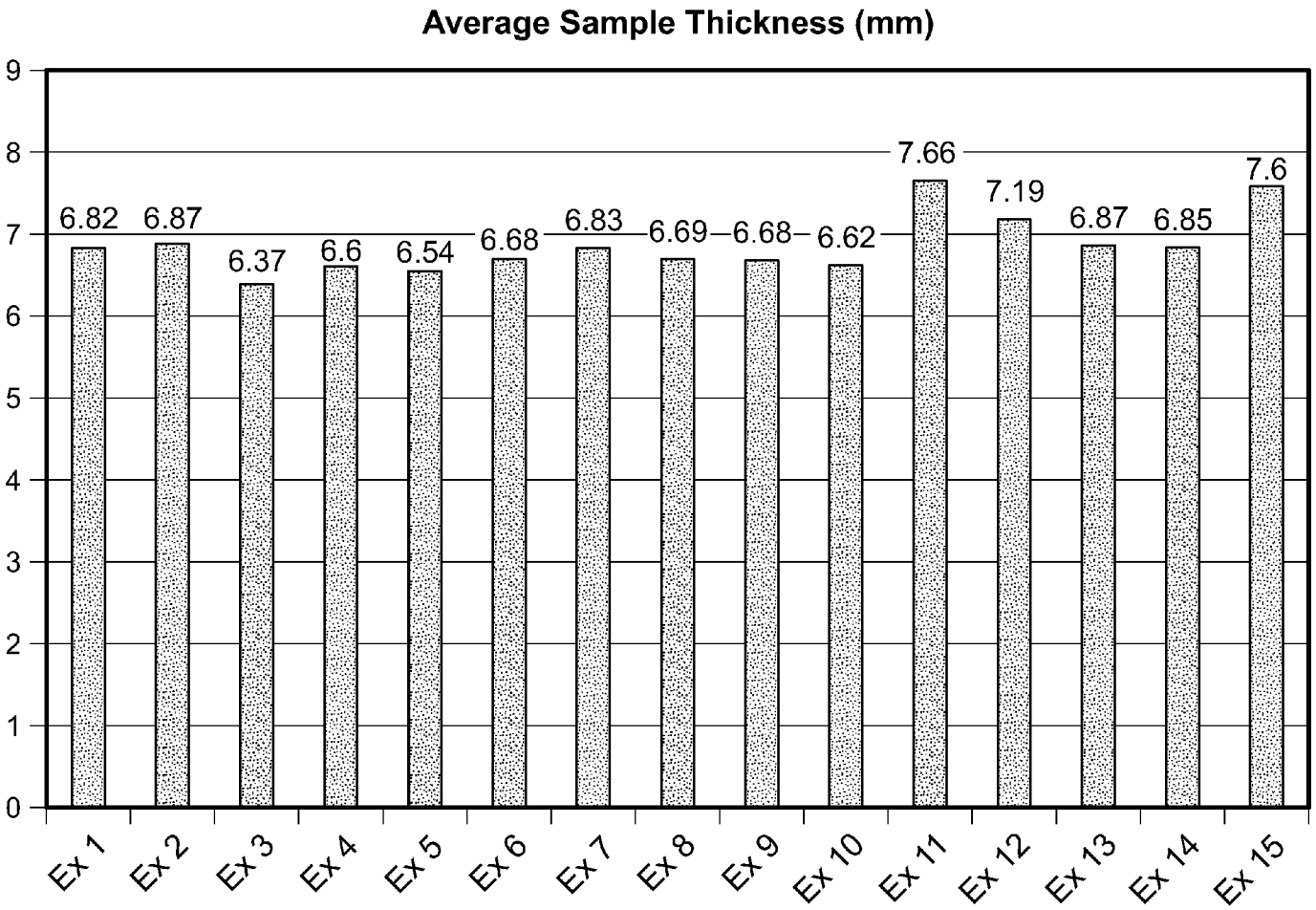
FIGS. 5A-5D are charts showing the average thicknesses, friabilities, three point bend strengths, and texture profile hardnesses, respectively, for different examples of preformed smokeless tobacco products.
Figure 5B:
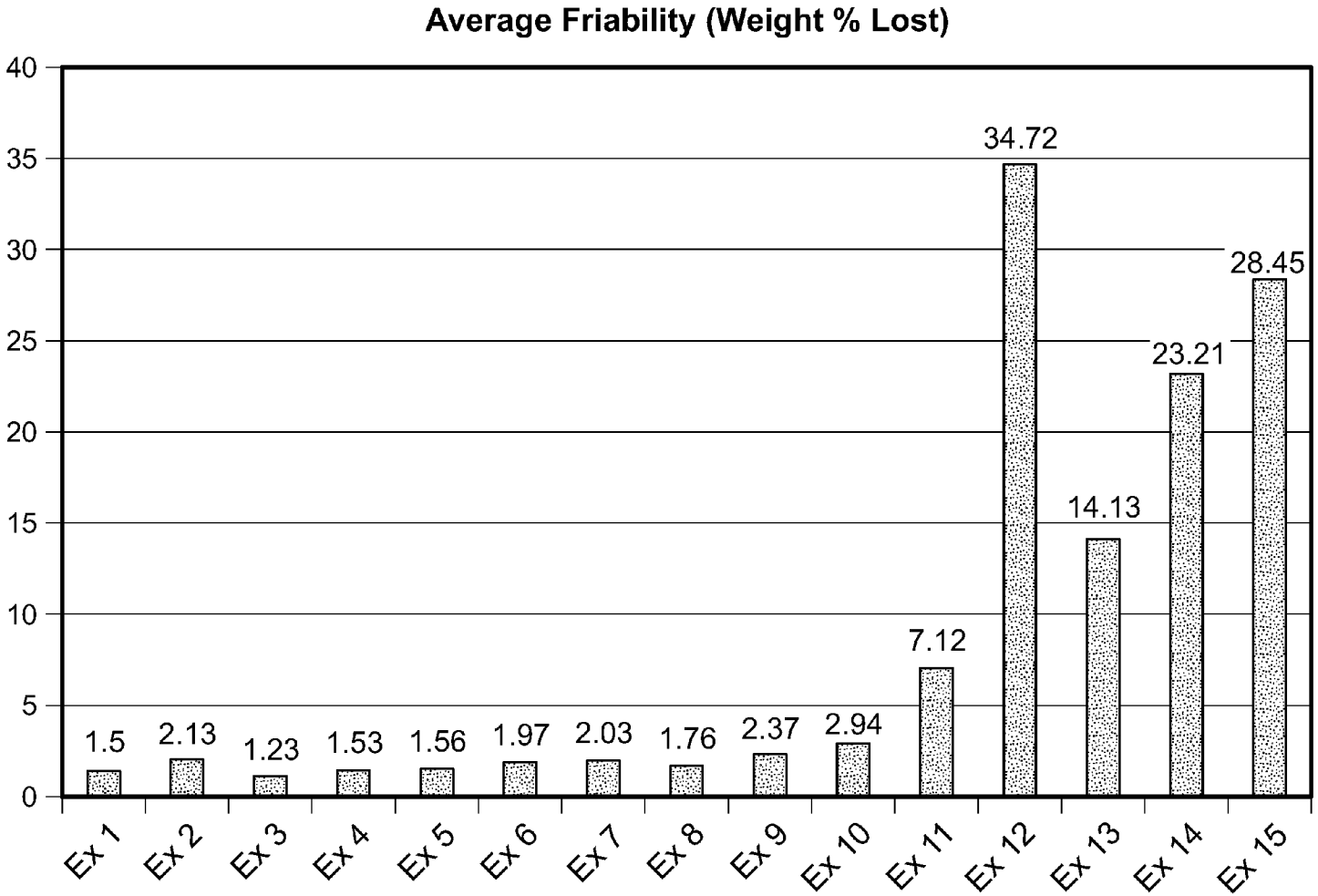
Figure 5C:
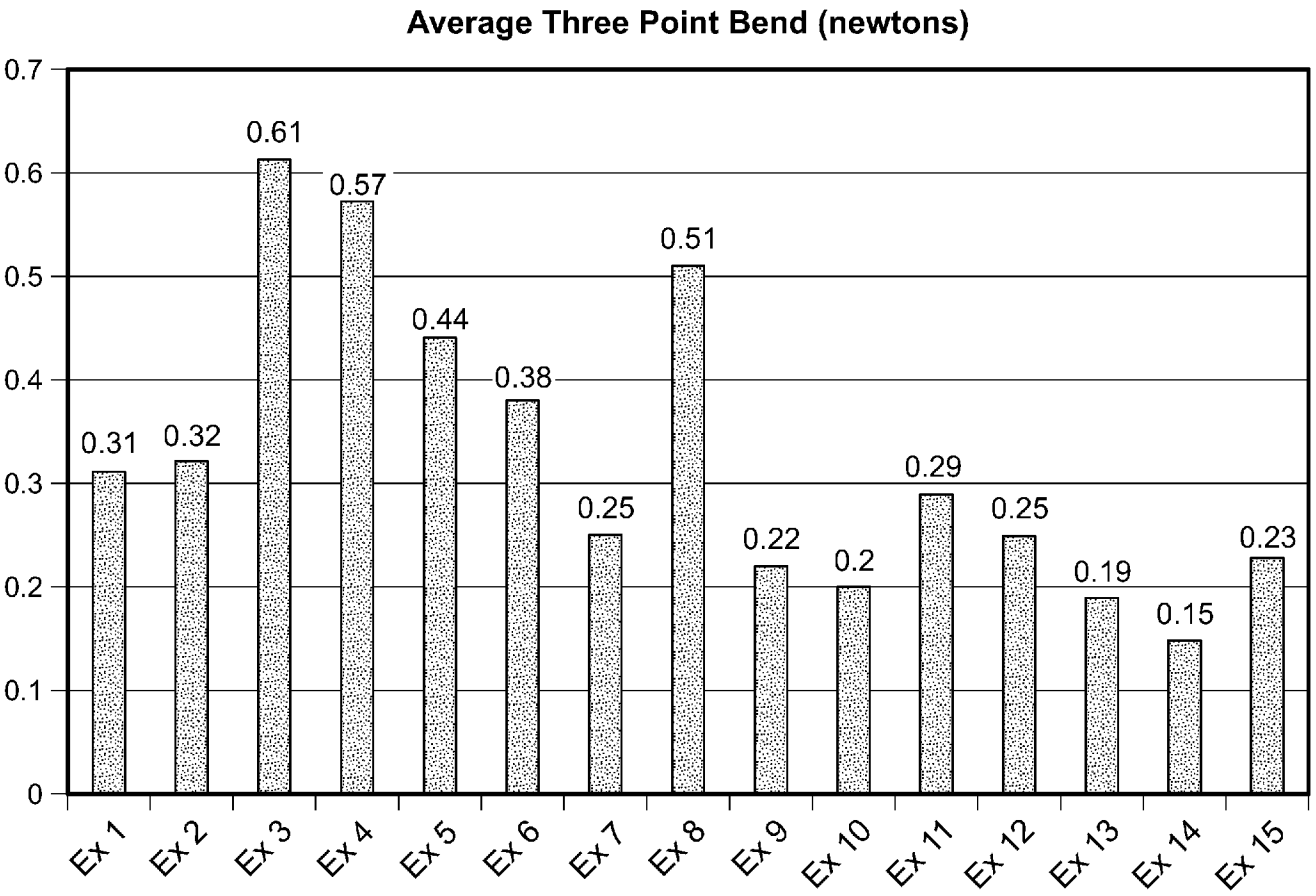
Figure 5D:
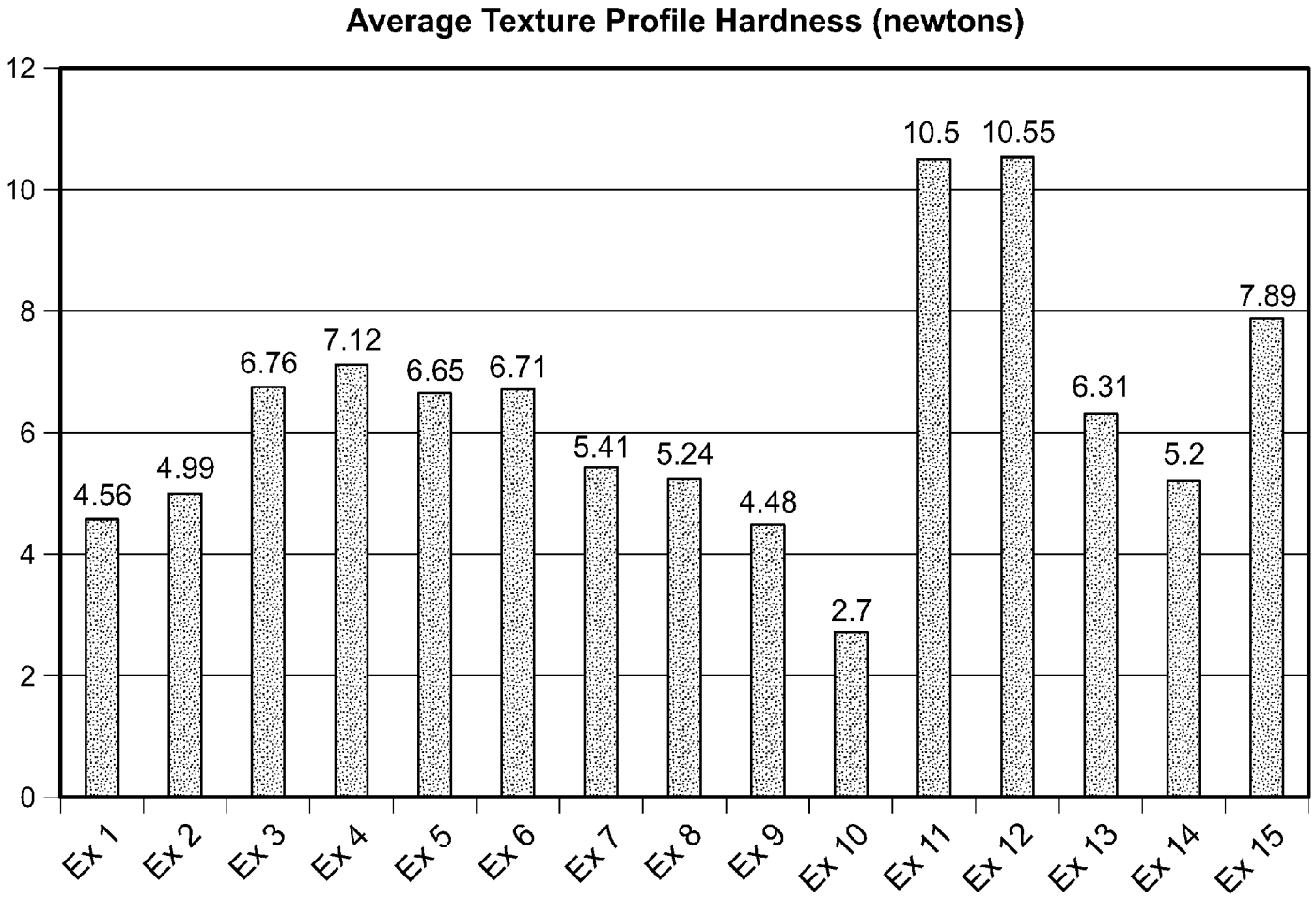

Three samples of each example were tested for individual product friability. Table I and FIG. 5B show the average individual product friability for each example. Fourteen samples of each example were tested for three point bend strength. Table I and FIG. 5C show the average three point bend strength for each example. Fourteen samples of each example were tested for texture profile hardness. Table I and FIG. 5D show the average texture profile hardness for each example.

Examples one, two, and fifteen each have substantially similar compositions and thus show the molding apparatus and molding method result in different friabilities, three point bend strengths, and texture profile hardnesses. The closed injection molding process using the FORMEX F-6 and F-19 units resulted in slightly different material properties, while the open molding process using the CORIO unit resulted in a significantly higher average individual product friability. Moreover, there was a wide standard deviation for the friabilities and three point bend strengths for the samples for Examples 11-15, while there was a relatively narrow standard deviation for the samples made using the closed mold Formex® F-6 and F-19 units. Examples 3-6 compare the differences of having the intermittent pressure function of the Formex® F-19 unit on or off. Examples 2-6 also compare samples having different amounts of binder. As shown, increasing the amount of binder reduces the average individual product friability, increases the three point bend strength, and increases the texture profile hardness of the samples. Increasing the amount of binder, however, also alters the mouth feel and flavor release of the preformed smokeless tobacco product. Examples 1-15 further test different specific binders and different significant amounts. Examples nine and 10 further test products having higher oven volatiles contents and show that increasing the oven volatiles increases individual product friability, decreases three point bend strength, and decreases texture profile hardness.

Figure 6A:
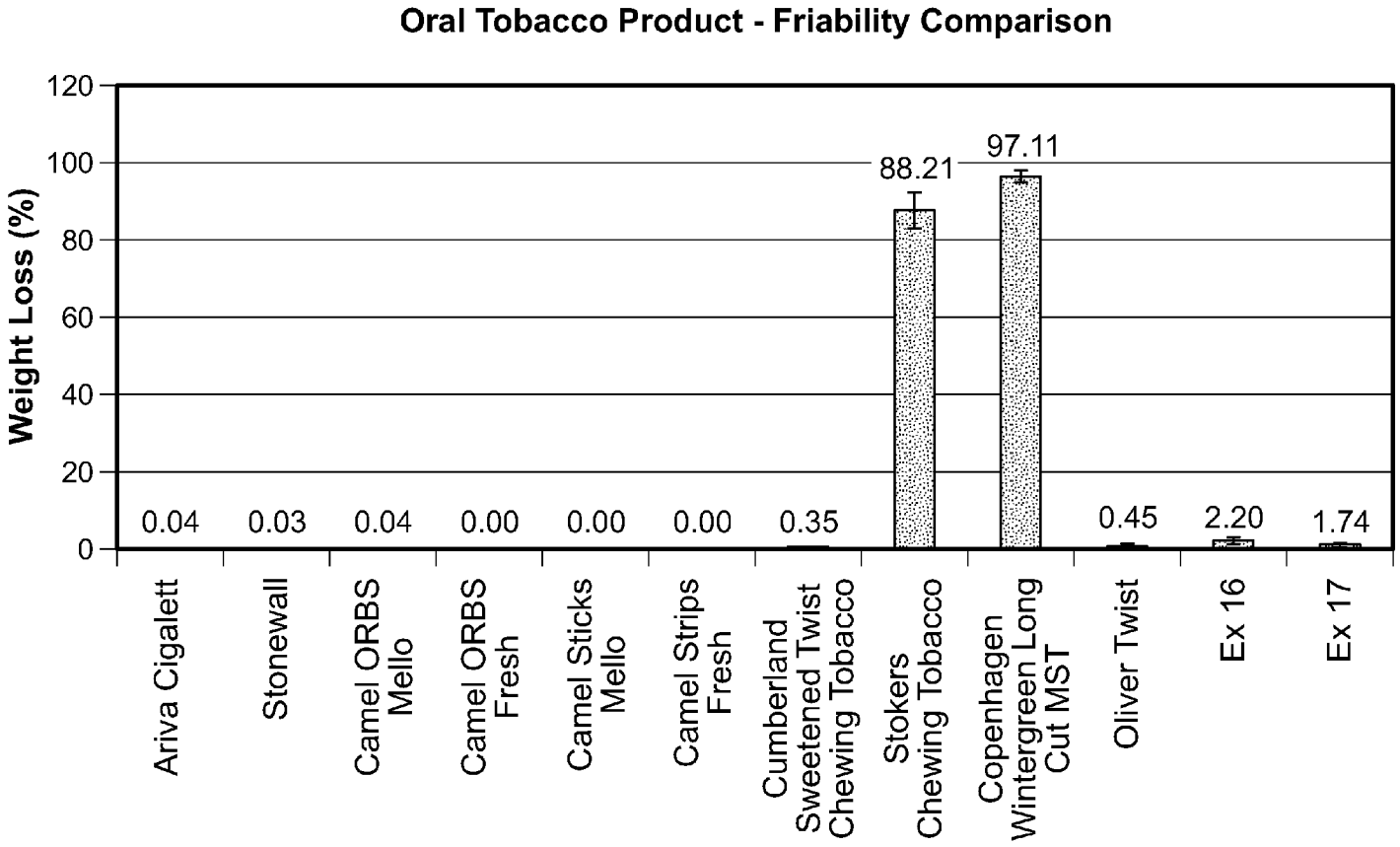
FIGS. 6A and 6B are charts showing the average friabilities and three point bend strengths for certain commercially available products and for two different examples of preformed smokeless tobacco products.
Figure 6B:
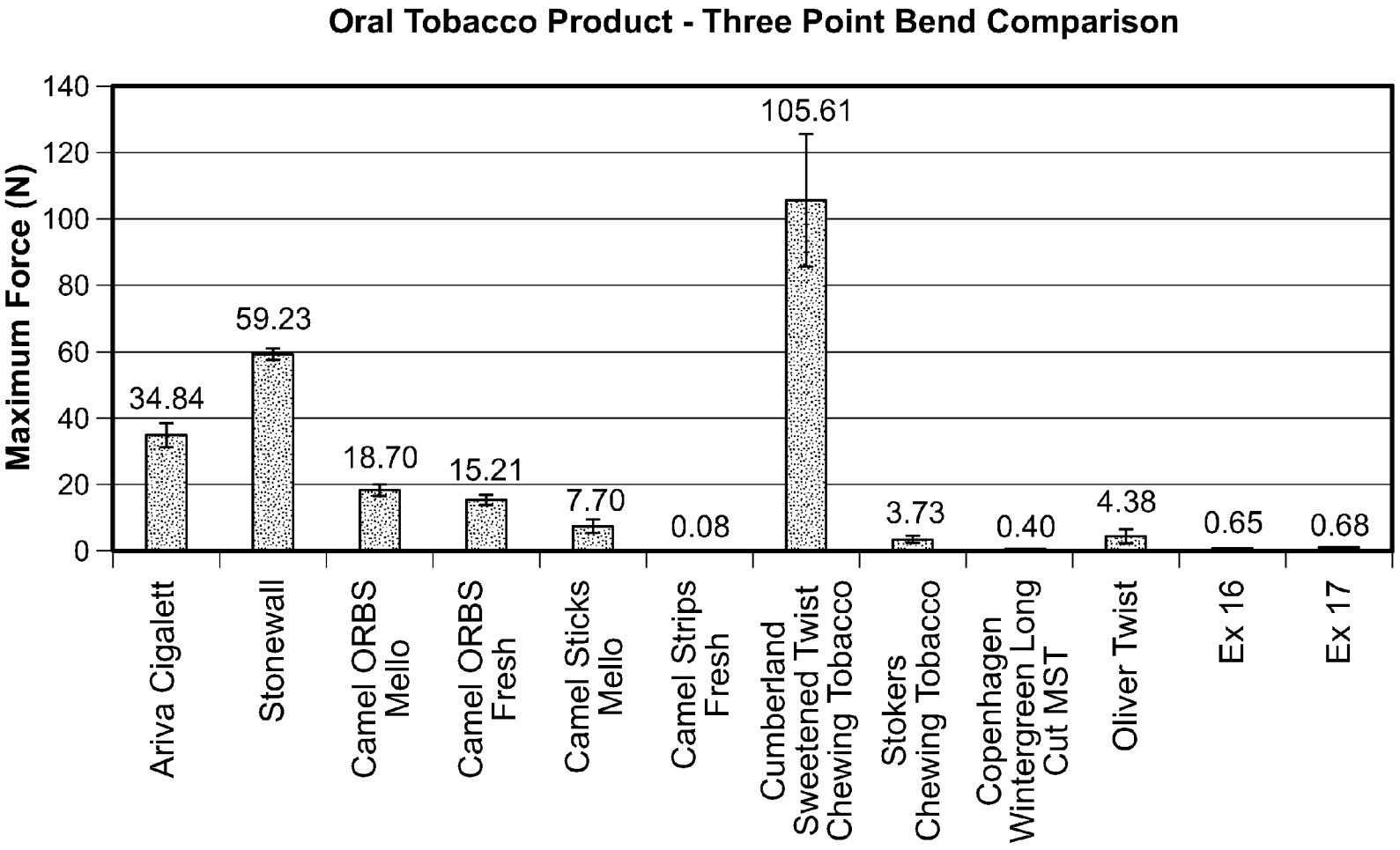

Tables II and III and FIGS. 6A-6B compare the individual product friability and three point bend strength of products made according to the processes described herein (Examples 16 and 17) with certain commercially available products. Examples 16 and 17 are similar to Example 2, but had different flavorants and additives. Table II and FIG. 6A provide the individual product friability analysis for each tested commercially available product as well as for Examples 16 and 17.

Table II describes how these products were prepared for the individual product friability test. Most products were added to the standard friability drum without any preparation. The Cumberland Sweetened Twist Chewing Tobacco, however, was cut into 30 mm lengths for the friability test. The chewing and moist smokeless tobaccos where formed into a pinch prior to testing. The number of samples tested varied between one sample for the CAMEL Strips Fresh to five for the Cumberland Sweetened Twist Chewing Tobacco, and six for Examples 16 and 17. As shown in both Table II and FIG. 6A, the average individual product friability for each commercially available product was either less than 0.5 weight percent or greater than 80 weight percent. The percent relative standard deviations are calculated by dividing the standard deviations by the average values, then multiplying by 100.

TABLE II

| Product | Preparation for Analysis | Replicates | Average (%) | Standard Deviation | % Relative Standard Deviation | Notes |
|---|---|---|---|---|---|---|
| Ariva Cigalett | none | 3 | 0.04 | 0.04 | 99.73 | |
| Stonewell | none | 3 | 0.03 | 0.05 | 173.38 | |
| Camel ORBS Mello | none | 3 | 0.04 | 0.08 | 173.14 | |
| Camel ORBS Fresh | none | 3 | 0 | 0 | 0 | |
| Camel Sticks Mello | none | 2 | 0 | 0 | 0 | |
| Camel Strips Fresh | none | 1 | 0 | 0 | 0 | Sample did not tumble in drum. |
| Cumberland Sweetened Twist Chewing Tobacco | cut to approximately 30 mm lengths | 5 | 0.35 | 0.18 | 51.26 | |
| Stokers Chewing Tobacco | approximately 3.0 g formed into a pinch | 3 | 88.21 | 4.1 | 4.65 | |
| Copenhagen Wintergreen Long Cut MST | approximately 2.5 g formed into a pinch | 3 | 97.11 | 1.03 | 1.06 | |
| Oliver Twist | none | 3 | 0.45 | 0.23 | 49.93 | |
| Example 16 | none | 6 | 2.2 | 0.58 | 26.28 | Wintergreen variant |
| Example 17 | none | 6 | 1.74 | 0.59 | 34.13 | Wintergreen variant |

Tables III and IV and FIG. 6B provide the three point bend analysis for each tested, commercially available product and Examples 16 and 17. For certain commercially available products (the ARIVA CIGALETT, STONEWALL, and CAMEL products), the samples used in the friability test were reused for the three point bend test. Given the low individual product friability of these samples, the friability test did not appear to have physically compromised these samples. The three point bend analysis for the Oliver Twist product was difficult because the samples tended to stick to the apparatus and stretch upon contact with the compression fixture, masking the true bending force. Accordingly, the three point bend strength for Oliver Twist was derived from the second derivative of the force output curve. Table III and FIG. 6B show the average and standard deviation for each commercially available product and for Examples 16 and 17. Table IV shows the sample width and the approximate bridge gap used to test the sample with the three point bend test. As illustrated, the bridge gap was set at approximately half the length of each sample type.

TABLE III

| Product | Preparation for Analysis | Replicates | Average (N) | Standard Deviation | % Relative Standard Deviation | Notes |
|---|---|---|---|---|---|---|
| Ariva Cigalett | none | 3 | 34.84 | 3.47 | 9.97 | |
| Stonewell | none | 3 | 59.23 | 1.46 | 2.47 | |
| Camel ORBS Mello | none | 3 | 18.7 | 1.6 | 8.58 | |
| Camel ORBS Fresh | none | 3 | 15.21 | 0.93 | 6.13 | |
| Camel Sticks Mello | none | 2 | 7.7 | 1.67 | 21.75 | |
| Camel Strips Fresh | none | 3 | 0.08 | 0.02 | 28.64 | |
| Cumberland Sweetened Twist Chewing Tobacco | cut to approximately 30 mm lengths | 5 | 105.61 | 19.68 | 18.63 | Sample thicknesses were variable (between 25 and 34 mm). |
| Stokers Chewing Tobacco | approximately 3.0 g formed into a pinch | 3 | 3.73 | 0.82 | 22 | |
| Copenhagen Wintergreen Long Cut MST | approximately 2.5 g formed into a pinch | 3 | 0.4 | 0.14 | 35.82 | |
| Oliver Twist | none | 5 | 4.38 | 1.84 | 42.02 | Product was very sticky and was stretching and bending (force calculated from second derivative). |
| Example 16 | none | 6 | 0.65 | 0.03 | 4.21 | Wintergreen variant |
| Example 17 | none | 6 | 0.68 | 0.13 | 19.6 | Wintergreen variant |

TABLE IV

| Product | Sample | Sample Width (mm) | Bridge Gap (mm) |
|---|---|---|---|
| Ariva Cigalett | Sample 1 | 11.0 | 5.5 |
| | Sample 2 | 11.0 | 5.5 |
| | Sample 3 | 11.0 | 5.5 |
| Stonewall | Sample 1 | 14.1 | 7.1 |
| | Sample 2 | 14.1 | 7.1 |
| | Sample 3 | 14.1 | 7.1 |
| Camel ORBS Mellow | Sample 1 | 11.6 | 5.8 |
| | Sample 2 | 11.6 | 5.8 |
| | Sample 3 | 11.6 | 5.8 |
| Camel ORBS Fresh | Sample 1 | 11.7 | 5.8 |
| | Sample 2 | 11.7 | 5.8 |
| | Sample 3 | 11.7 | 5.8 |
| Camel Sticks Mellow | Sample 1 | 75.0 | 37.5 |
| | Sample 2 | 75.0 | 37.5 |
| Camel Strips Fresh | Sample 1 | 30.5 | 15.2 |
| | Sample 2 | 30.5 | 15.2 |
| | Sample 3 | 30.5 | 15.2 |
| Cumberland Sweetened Twist Chewing Tobacco | Sample 1 | 34.11 | 17.1 |
| | Sample 2 | 29.79 | 17.1 |
| | Sample 3 | 29.43 | 17.1 |
| | Sample 4 | 27.54 | 17.1 |
| | Sample 5 | 25.17 | 17.1 |
| Stokers Chewing Tobacco | Sample 1 | 34.11 | 17.1 |
| | Sample 2 | 26.08 | 17.1 |
| | Sample 3 | 29.18 | 17.1 |
| Copenhagen WG Long Cut MST | Sample 1 | 30.73 | 15.3 |
| | Sample 2 | 28.87 | 15.3 |
| | Sample 3 | 30.95 | 15.3 |
| Oliver Twist Chewing Tobacco Bits | Sample 1 | 10.35 | 5.2 |
| | Sample 2 | 9.34 | 5.2 |
| | Sample 3 | 10.00 | 5.2 |
| | Sample 4 | 9.23 | 5.2 |
| | Sample 5 | 10.05 | 5.2 |
| Example 16 | Sample 1 | 29.28 | 15.0 |
| | Sample 2 | 30.10 | 15.0 |
| | Sample 3 | 29.36 | 15.0 |
| | Sample 4 | 28.62 | 15.0 |
| | Sample 5 | 28.30 | 15.0 |
| | Sample 6 | 30.40 | 15.0 |

TABLE IV-continued

| Product | Sample | Sample Width (mm) | Bridge Gap (mm) |
|---|---|---|---|
| Example 17 | Sample 1 | 29.96 | 15.0 |
| | Sample 2 | 30.56 | 15.0 |
| | Sample 3 | 29.81 | 15.0 |
| | Sample 4 | 30.42 | 15.0 |
| | Sample 5 | 30.28 | 15.0 |
| | Sample 6 | 29.45 | 15.0 |

It is to be understood that, while the systems, products, compositions of matter, and methods have been described herein in conjunction with a number of different embodiments, the foregoing description of the various embodiments is intended to illustrate and not limit the scope of the systems, products, compositions of matter, and methods. Other embodiments, advantages, and modifications are within the scope of the following claims.

What is claimed is:

1. A system comprising:

a container including a lid and a base that defines an interior space; and a plurality of preformed smokeless tobacco products having a substantially similar shape and being disposed in the interior space of the container, each of the preformed smokeless tobacco products comprising loose tobacco and a binder compressed into the substantially similar shape such that at least a portion of the loose tobacco is exposed along exterior surfaces of each of the preformed smokeless tobacco products, the preformed smokeless tobacco products having an average individual product friability of between 1 weight percent and 4 weight percent, wherein the preformed smokeless tobacco products have an average three point bend strength of between 0.25 N and 4.0 N, wherein the preformed smokeless tobacco products have an average texture profile hardness of between 2.0 N and 12.0 N, wherein each of the preformed smokeless tobacco products comprises at least 40 weight percent moisture, wherein each of the preformed smokeless tobacco products comprises between 0.5 weight percent and 5 weight percent binder.

2. The system of claim 1, wherein the system has a whole package friability of less than 20 weight percent.

3. The system of claim 1, wherein each of the preformed smokeless tobacco products has a substantially similar shape, having at least one pair of opposing, generally parallel exterior surfaces.

4. The system of claim 1, wherein each of the preformed smokeless tobacco products comprises a flavorant.

5. The system of claim 1, wherein the binder is selected from the group consisting of a hydroxyl containing compound, a dextrin or dextrin derivative, carboxymethyl cellulose, hydroxypropyl cellulose, hydroxyethyl cellulose, hydroxypropyl methyl cellulose, methyl cellulose, konjac, collagen, inulin, soy protein, whey protein, casein, wheat gluten, carrageenan, alginates, propylene glycol alginate, xanthan, dextrin, pullulan, curdlan, gellan, locust bean gum, guar gum, tara gum, gum tragacanth, pectin, agar, zein, karaya, gelatin, psyllium seed, chitin, chitosan, gum acacia, polyvinyl pyrrolidone, polyethylene oxide, polyvinyl alcohol, and combinations thereof.

6. The system of claim 1, wherein the binder is selected from the group consisting of guar gum, xanthan, cellulose, and combinations thereof.

7. The system of claim 1, wherein the binder comprises guar gum.

8. The system of claim 1, wherein the binder comprises guar gum, cellulose, and xanthan.

9. The system of claim 1, wherein each of the preformed smokeless tobacco products comprises between 0.5 weight percent binder and 1.5 weight percent binder.

10. The system of claim 1, wherein the loose tobacco is moist loose, cured, fermented tobacco.

11. The system of claim 1, wherein the loose tobacco comprises tobacco prepared from plants having less than 20 μg of DVT per $cm^2$ of green leaf tissue.

12. The system of claim 1, wherein the plurality of preformed smokeless tobacco products each have a thickness that is at least 50 percent of an internal height of the container.

13. The system of claim 1, wherein the tobacco is long-cut tobacco.

14. A preformed smokeless tobacco product comprising a shaped smokeless tobacco body having a defined shape, the shaped smokeless tobacco body comprising tobacco and a binder, the shaped smokeless tobacco body having an individual product friability of between 0.5 weight percent and 10 weight percent, wherein the shaped smokeless tobacco body has a three point bend strength of at least 0.25 N and less than 4.0 N, wherein the shaped smokeless tobacco body has a texture profile hardness of at least 2.0 N and less than 12.0 N. wherein the shaped smokeless tobacco body comprises at least 40 weight percent moisture and between 0.5 weight percent and 1.5 weight percent binder.

15. The product of claim 14, wherein the binder is selected from the group consisting of guar gum, xanthan, cellulose, and combinations thereof.

16. The product of claim 14, wherein the binder comprises guar gum, cellulose, and xanthan.

17. The product of claim 16, wherein the shaped smokeless tobacco body comprises between 0.6 and 0.8 weight percent binder.

18. The product of claim 14, wherein the tobacco is moist long-cut fermented cured tobacco.

19. The product of claim 14, wherein the tobacco is long-cut tobacco.

20. A preformed smokeless tobacco product comprising a shaped smokeless tobacco body having a defined shape, the shaped smokeless tobacco body comprising tobacco and a binder, the shaped smokeless tobacco body has an individual product friability of between 1.7 and 2.1 weight percent, a three point bend strength of between 0.25 N and 0.8 N, and a texture profile hardness of between 4.5 N and 5.5 N, wherein the shaped smokeless tobacco body comprises between 50 and 61 weight percent oven volatiles, wherein the shaped smokeless tobacco body comprises between 0.5 weight percent and 1.5 weight percent binder.

21. The product of claim 20, wherein the tobacco is long-cut tobacco.

* * * * *